US005190275A

United States Patent [19]

Adamski, Jr. et al.

[11] Patent Number: 5,190,275

[45] Date of Patent: Mar. 2, 1993

[54] SLEEVE LOADER

[75] Inventors: Maximilian Adamski, Jr., Palatine; Paul A. Berg, Crystal Lake; Robert L. Kosrow, Hoffman Estates, all of Ill.

[73] Assignee: Union Special Corporation, Chicago, Ill.

[21] Appl. No.: 405,704

[22] Filed: Sep. 11, 1989

[51] Int. Cl.[5] ..... B65H 3/44

[52] U.S. Cl. ..... 271/9; 271/11; 271/18.3; 271/227; 271/228

[58] Field of Search ..... 271/1, 3, 4, 5, 9, 10, 271/11, 14, 15, 18.3, 97, 227, 228, 225, 184–186; 112/303–305, 306, 314, 318, 18, 27, 47, 80.32, 461, 178

[56] References Cited

U.S. PATENT DOCUMENTS 4,693,460 9/1987 Adamson et al. ..... 271/10

*Primary Examiner*—David H. Bollinger

*Attorney, Agent, or Firm*—Morgan & Finnegan

[57] ABSTRACT

A sleeve loader having a table for positioning trays container either a stack of folded or unfolded sleeves at a processing position, a device for lifting up an upper ply of a garment in the stack of sleeves, a device for picking up the upper ply of the sleeves in the stack, a device for assuring the correct orientation of the sleeve for sewing, a device for alignment of the sleeves in a correct position for sewing, and a device for rejecting sleeves having an undesirable characteristic or orientation.

37 Claims, 13 Drawing Sheets

FIG. 10
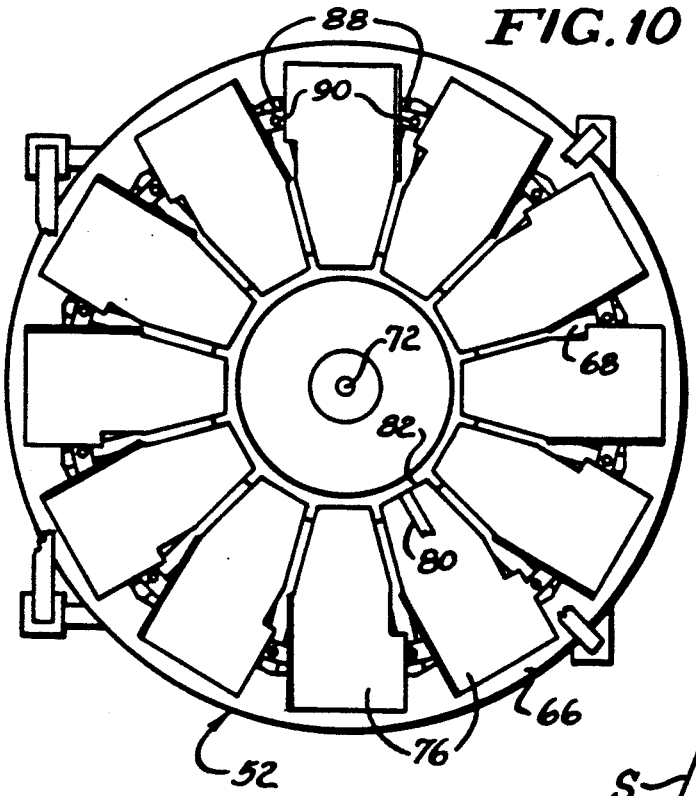
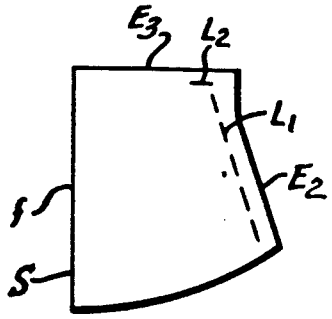
FIG. 12
FIG. 13
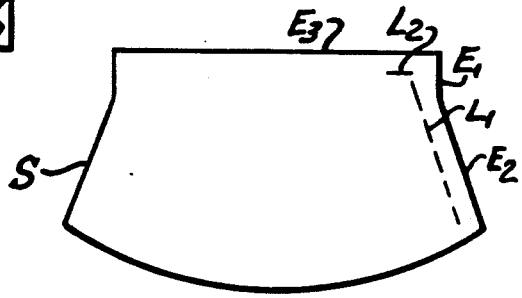
FIG. 11
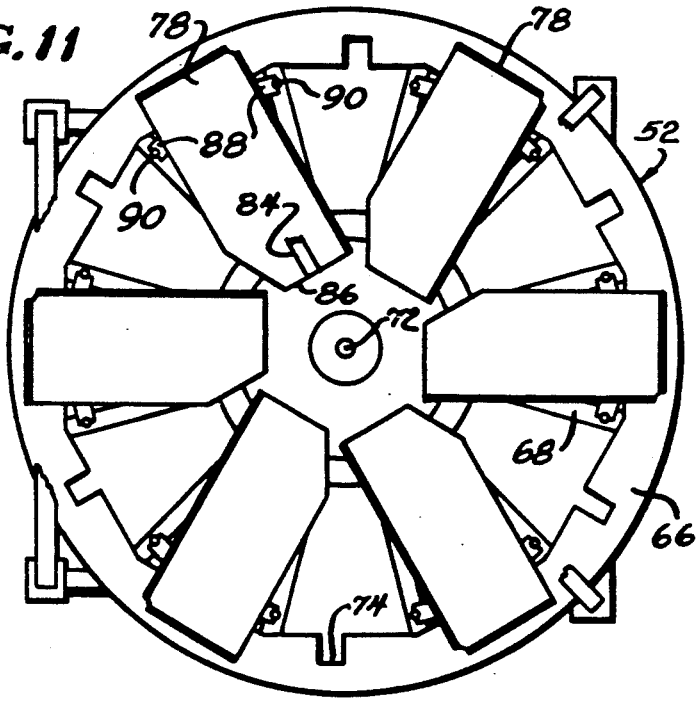

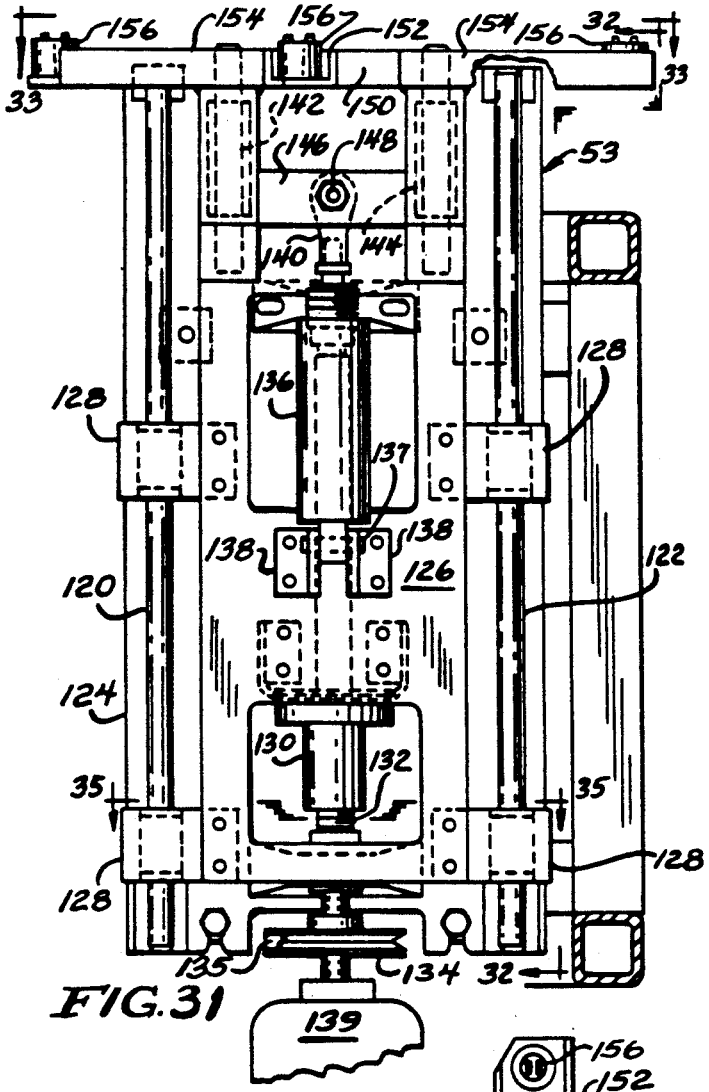
FIG. 31
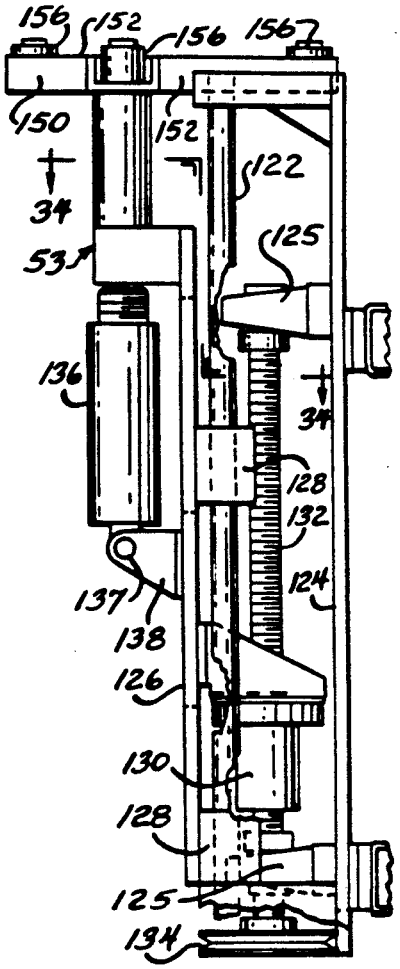
FIG. 32
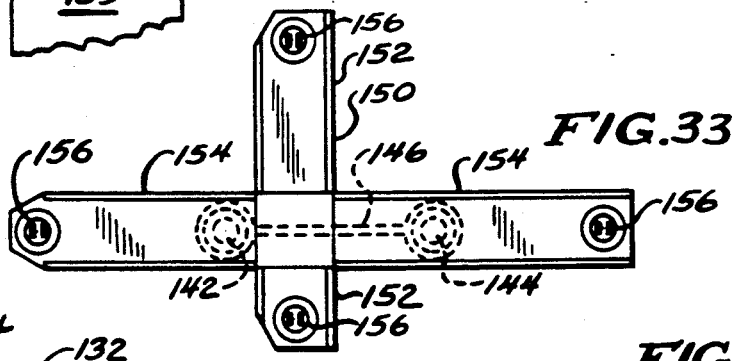
FIG. 33
FIG. 34
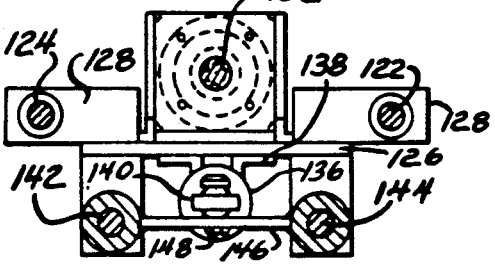
FIG. 35
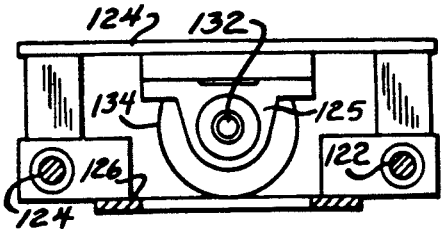

SLEEVE LOADER

BACKGROUND OF THE INVENTION

The present invention relates to a device for loading sleeves.

In the automatic operation of sewing sleeves, such as hemming by a suitable sewing machine, it is desirable to process the sleeves in an automatic and simplified manner to the sewing machine while minimizing or eliminating the intervention of an operator. Thus, it is desirable to enhance the loading and processing of sleeves for the sewing machine in a faster and more reliable manner. For example, it is desirable to facilitate the pick up of the sleeves, and process either stacks of folded or unfolded sleeves.

SUMMARY OF THE INVENTION

A principal feature of the present invention is the provision of a sleeve loader of simplified construction.

The sleeve loader of the present invention comprises a rotatable table for retaining a stack of garments or sleeves, means for lifting an upper ply of the garment stack, means for picking up the upper ply of the garment stack, means for passing the lifted garment toward a sewing machine, means for aligning the garment during passage towards the sewing machine, and means for rejecting an undesired garment during passage to the sewing machine.

A feature of the present invention is that the table retains a plurality of trays of different size for separate use with flat or unfolded sleeves.

Another feature of the invention is that the different size trays may be utilized to hold a stack of sleeves in a folded or unfolded configuration.

Yet another feature of the invention is that the different size trays may be placed on the table in different configurations for processing by the sleeve loader of the present invention.

Still another feature of the invention is that the table is rotated to place a tray with a stack of garments in position for processing by the sleeve loader, and is locked in place during the processing.

Another feature of the invention is that the table may be rotated different predetermined distances to place either of the fold or flat trays at the processing position.

Yet another feature of the invention is that the trays are raised into the processing position in an improved manner.

Yet another feature of the invention is that the sleeve loader has a retaining device for the trays which may be raised and lowered at relatively fast and slow speeds, and may be separately raised or lowered a predetermined distance for placement of the sleeves at the processing position.

Another feature of the invention is that the retaining device releasably retains either of the different size trays.

Another feature of the invention is the provision of a gripper finger carriage having a plurality of aligned pick up fingers which may be opened and closed to grasp an upper ply of the garment stack.

A further feature of the invention is that the gripper finger carriage is moved toward an edge of the garment stack, and the edge is sensed in order to position the gripper finger carriage at a proper position for grasping the garments by the pick up fingers.

A further feature of the invention is that the pick up fingers are rotated to a preselected angle for alignment of the pick up fingers with an edge of the sleeves in position for picking up the sleeves.

Still another feature of the invention is the provision of a pick up finger which is maintained at a fixed position to facilitate picking up of the sleeves.

Yet another feature of the invention is the provision of a flutter finger carriage having a plurality of aligned flutter fingers having orifices to direct the passage of gas against a lower surface of a plate in order to facilitate lifting of an edge of the sleeves before pick up.

Another feature of the invention is that the flutter fingers may be rotated and locked in place at the predetermined angle of the pick up fingers.

Yet another feature of the invention is that the flutter fingers are extended to a location between the pick up fingers to facilitate separation of the garments or the sleeves.

A further feature of the invention is the provision of a stationery flutter finger which passes air to facilitate lifting of the sleeve which is extended to a position between the rotated pick up fingers and the stationery pick up finger.

Another feature of the invention is the provision of a plurality of hold down fingers located intermediate the flutter fingers which are actuated in order to hold a ply of the sleeves beneath the ply being lifted.

A further feature of the invention is the provision of a stationery hold down finger associated with the stationery flutter finger.

Another feature of the invention is that the angular position of the rotated pick up fingers is determined, and the angle of the flutter fingers is indicated in response to the determined angle position of the pick up fingers.

Still another feature of the invention is the provision of a main flutter assembly having a rotatable plate with an orifice for placement at a plurality of positions over a stack of sleeves for passage of air to facilitate lifting of the garments beneath the opening.

A further feature of the invention is that the sleeve loader may determine the surface texture of the sleeves on the loader.

Yet another feature of the invention is that the sleeve loader of the present invention may pass the sleeves to the sewing machine if the sleeves are located in the correct orientation.

Yet another feature of the invention is that the sleeve loader inverts the sleeves into a reverse orientation in the event that the sleeves are located in incorrect initial orientation.

A further feature of the invention is the provision of an alignment assembly which aligns the garments at a desired position in an improved manner.

Still another feature of the invention is that the alignment assembly makes a course and fine adjustment to the alignment of the sleeves to the desired position.

A further feature of the invention is that the device determines various undesirable orientations and configurations of the sleeves, and prevents passage of the undesirable sleeves to the sewing machine.

A further feature of the invention is that the undesirable sleeves are rejected in an improved manner, while passing desirable sleeves to the sewing machine for sewing.

Yet another feature of the invention is that either folded or unfolded sleeves may be processed by the sleeve loader of the present invention.

Further features will become more fully apparent in the following description of the embodiments of this invention and from the appended claims.

DESCRIPTION OF THE DRAWINGS

In the drawings:

FIG. 10 is a top plan view of the table illustrating use of a plurality of small trays on the table for folded sleeves;

FIG. 11 is a top plan view of the table illustrating the use of a plurality of spaced larger trays on the table for use with unfolded flat sleeves;

FIG. 12 is a plan view of a folded sleeve which is processed by the sleeve loader of the present invention;

FIG. 13 is a plan view of an unfolded flat sleeve which is processed by the sleeve loader of the present invention;

FIG. 31 is an elevational view of a tray elevating device for a table of the present invention;

FIG. 32 is an end view, partly broken away, taken substantially as indicated along the line 32—32 of FIG. 31;

FIG. 33 is a partial top plan view taken substantially as indicated along the line 33—33 of FIG. 31;

FIG. 34 is a sectional view taken substantially as indicated along the line 34—34 of FIG. 32;

FIG. 35 is a sectional view taken substantially as indicated along the line 35—35 of FIG. 31;

DESCRIPTION OF THE PREFERRED EMBODIMENTS

Figure 3:
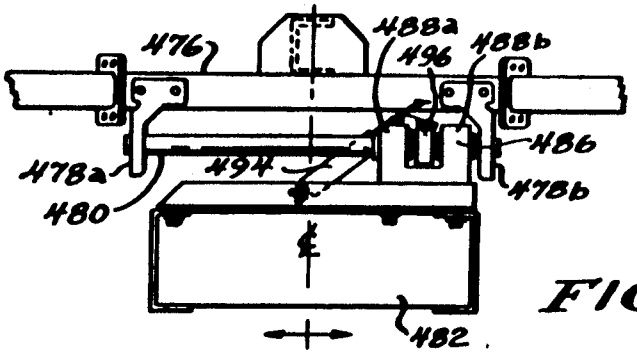
FIG. 3 is a fragmentary end view taken substantially as indicated along the line 3—3 of FIG. 1.
Figure 2:
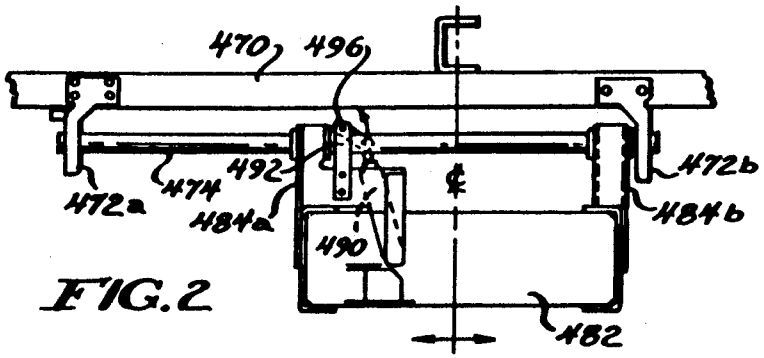
FIG. 2 is a fragmentary end view taken substantially as indicated along the line 2—2 of FIG. 1.
Figure 1:
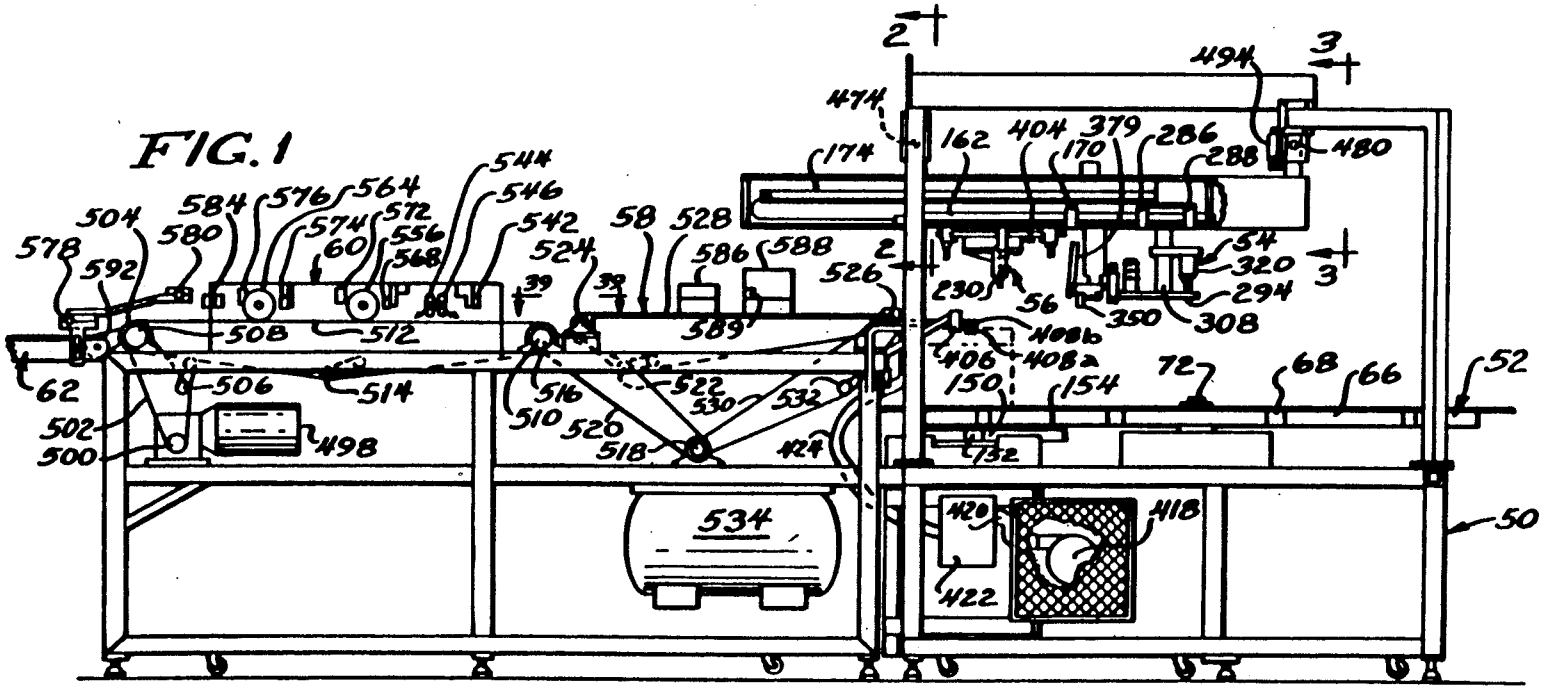
FIG. 1 is an elevational view of a sleeve loader of the present invention.
Figures 4, 5:
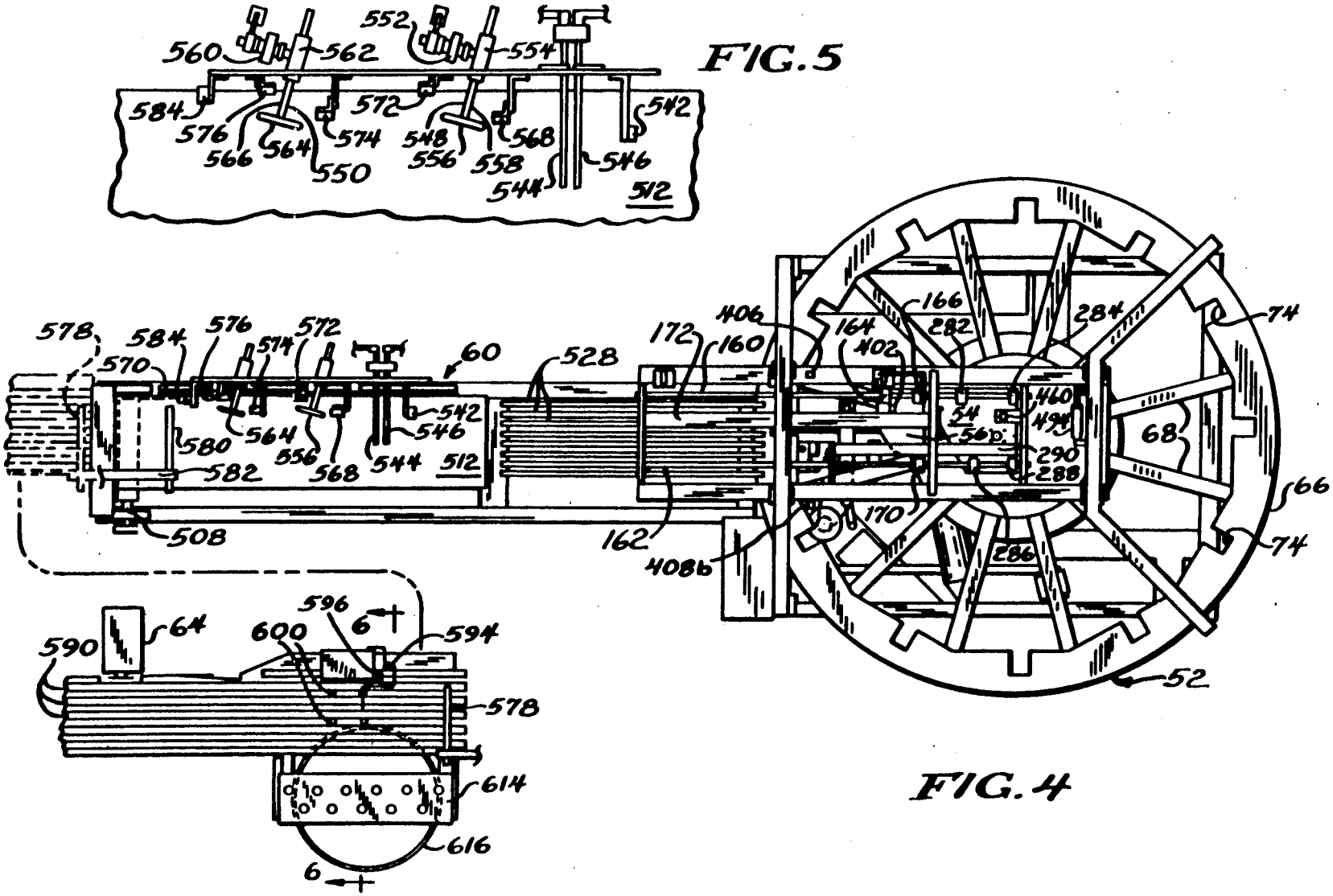
FIG. 4 is a fragmentary plan view of the sleeve loader of FIG. 1 of the present invention.
FIG. 5 is a fragmentary plan view illustrating an alignment assembly of FIG. 1.

Referring now to FIGS. 1 and 4, there is shown a sleeve or garment loader generally designated 50 having a rotatable table 52, a flutter finger carriage 54, a gripper finger carriage 56, a detection assembly 58, an alignment assembly 60, and a rejection assembly 62. As will be discussed further below, the sleeve loader 50 is designed to process either flat sleeves S as shown in FIG. 13 or folded sleeves S' of the type in which the sleeves S of FIG. 13 are folded along a lateral central fold line f, as shown in FIG. 12. The sleeves S and S' may be of the type having a relatively small straight side edge E1, and a longer straight or curved side edge E2 extending from the edge E1. The sleeves S or S' are processed by the sleeve loader 50 in order to place them in a proper configuration for sewing by a suitable sewing machine 64, such as a device to form hems, in the sleeves.

With references to FIGS. 4, and 7-11, the table 52 has an outer annular rim 66 secured to a vertical sleeve 70 by a plurality of outwardly extending bars 68 which connect the sleeve 70 and rim 66. The sleeve 70 is rotatably mounted on a central shaft 72 to permit rotation of the table 50 about the shaft 72. As shown, the rim 66 has a plurality of inwardly directed cut-outs 74 for a purpose which will be described below.

Figure 7:
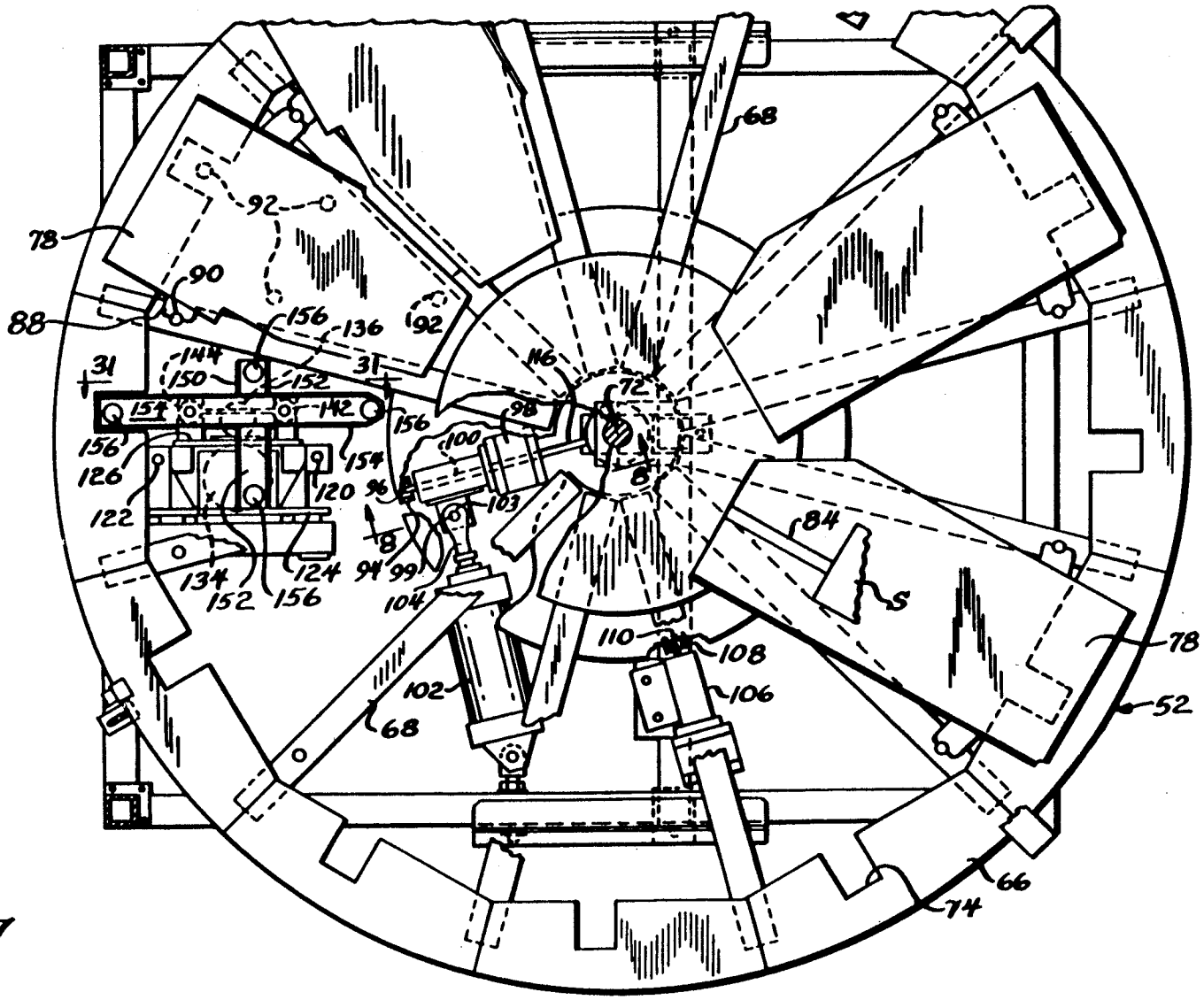
FIG. 7 is a fragmentary top plan view illustrating a table of the sleeve loader with a plurality of trays located on the table.
Figure 14:
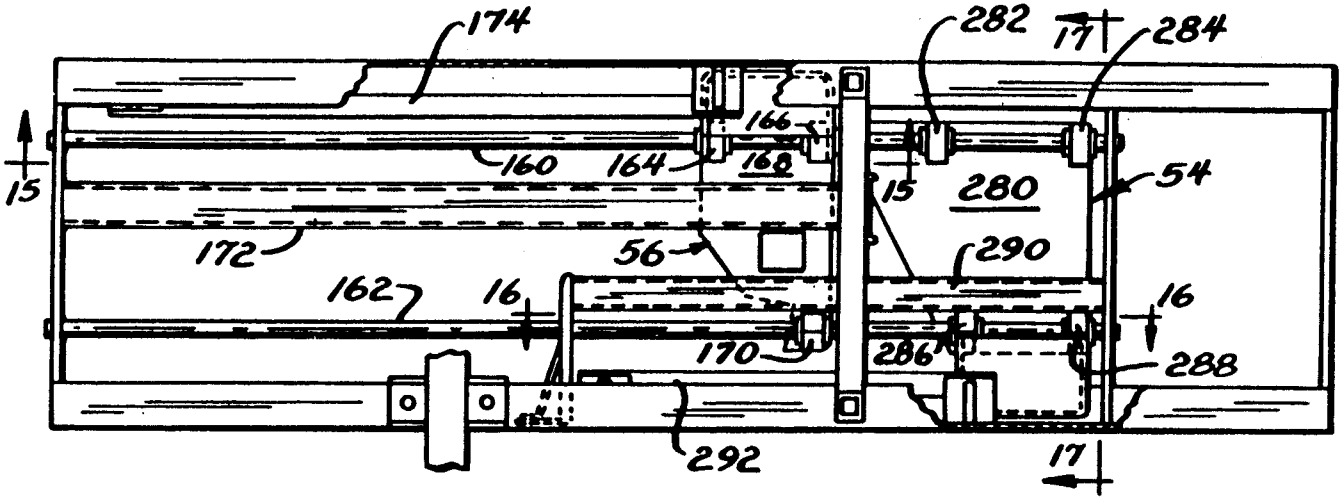
FIG. 14 is a top plan view, partly broken away, of a carriage assembly including a flutter finger carriage and a gripper finger carriage of the sleeve loader of FIG. 1.
Figure 15:
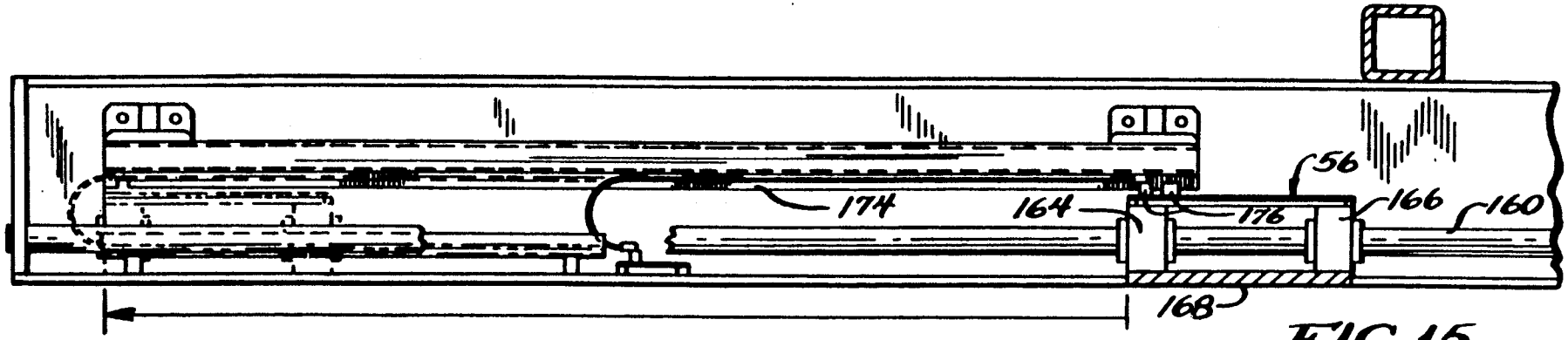
FIG. 15 is a fragmentary sectional view taken substantially as indicated along the line 15—15 of FIG. 14.
Figure 16:
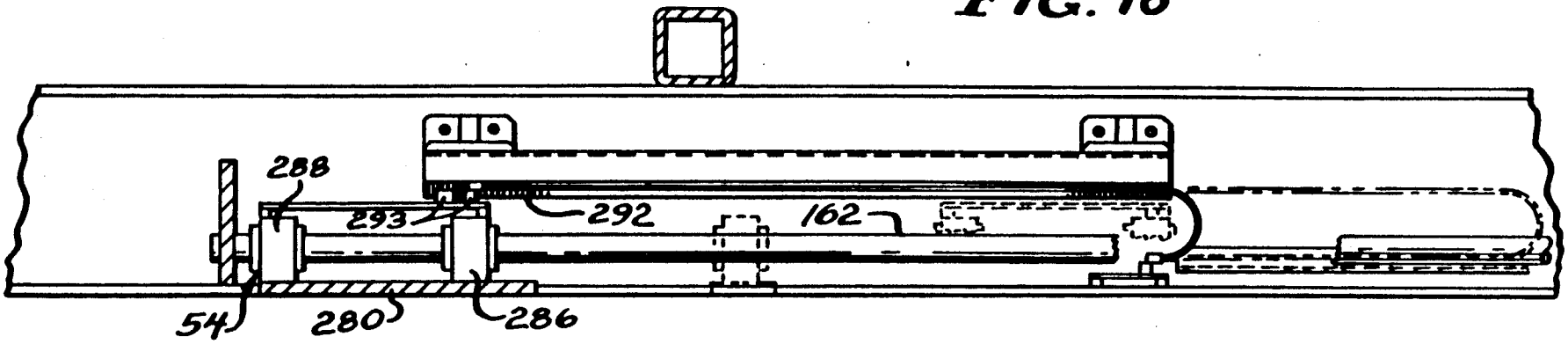
FIG. 16 is a fragmentary sectional view taken substantially along the line 16—16 of FIG. 14.
Figure 17:
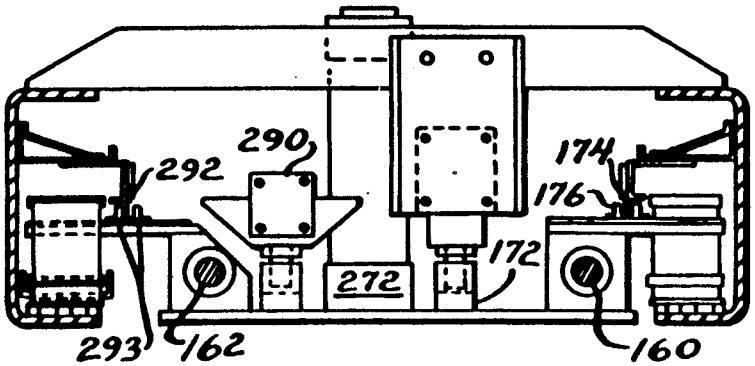
FIG. 17 is a sectional view taken substantially as indicated along the line 17—17 of FIG. 14.

With reference to FIGS. 10 and 11, the table 52 in suitable form is designed to receive twelve relatively small first trays 76, as shown in FIG. 10, or six relatively large second trays 78 located in a spaced configuration, as shown in FIG. 11. The small trays 76 of FIG. 10 are designed to retain a plurality of stacked folded sleeves S', such as 96 sleeves on the tray 76. The large trays 78 of FIG. 11 are designed to retain a stack of unfolded sleeves S, such as 192 sleeves on each tray 78. As shown in FIG. 10, the trays 76 have a reflective strip 80 extending from an inner edge 82 of the trays 76. Similarly, the trays 78 of FIG. 11 have a reflective strip 84 extending from an inner edge 86 of the trays 78. The trays 76 and 78 of FIGS. 10 and 11 have opposed, outwardly directed flanges 88 having outer recesses to receive pins 90 extending from the bars 68 in order to facilitate retention of the trays 76 and 78 in place on the table 52. As best shown in FIG. 7, the trays 76 and 78 have a plurality of metal plates 92 secured to a lower surface of the trays for a purpose which will be described below.

Figure 9:
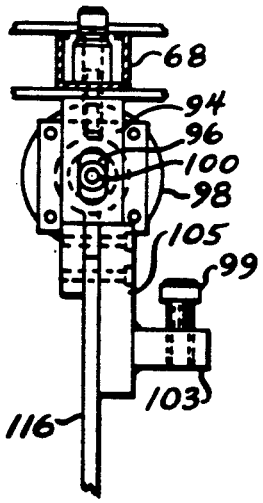
FIG. 9 is an end view taken substantially as indicated along the line 9—9 of FIG. 8.
Figure 8:
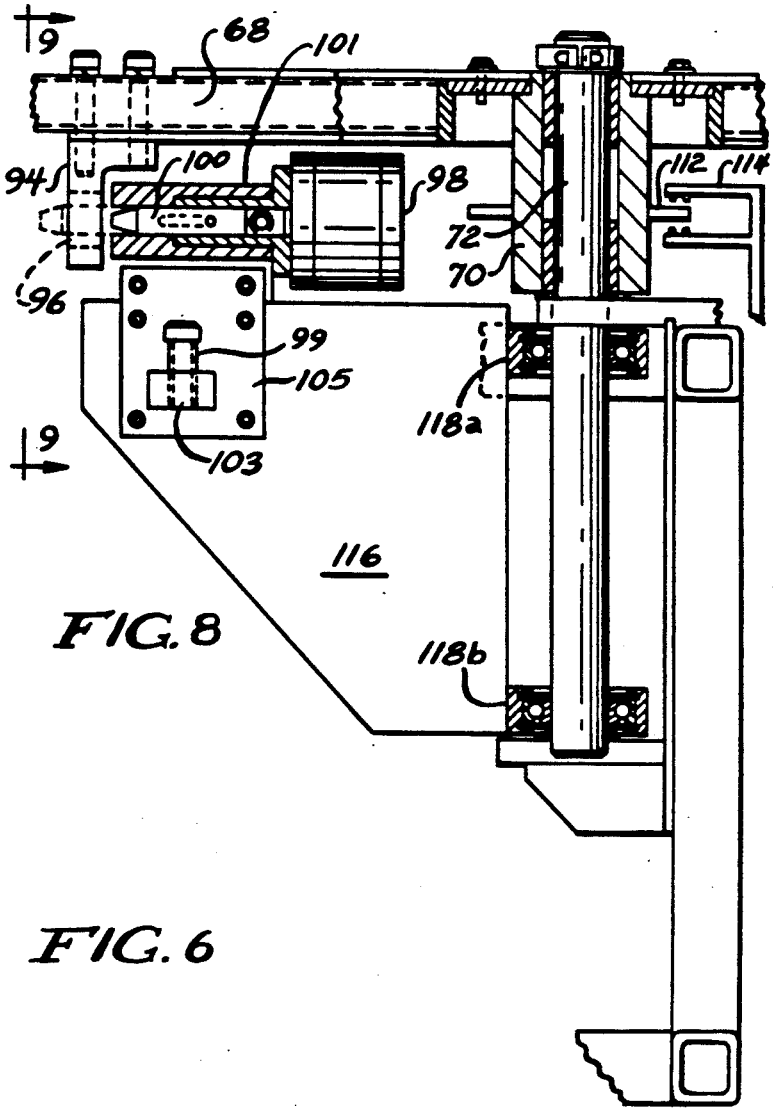
FIG. 8 is a fragmentary sectional view taken substantially as indicated along the line 8—8 of FIG. 7.

Whether or not the table 52 retains the trays 76 or trays 78, the table 52 is indexed during operation of the sleeve loader 50 in order to position the trays 76 or 78 for processing of the respective sleeves S or S'. The sleeves S and S' have course and smooth weaves on opposed sides. With reference to FIGS. 7–9, the bars 68 have depending blocks 94 having bores 96 extending therethrough. The table 52 has a cylinder 98 with a piston 100 which may be extended by the cylinder 98 through the bores 96 of the blocks 94, and may be retracted as desired. The table 52 has a cylinder 102 having an extendable piston 104 pivotally connected to the cylinder 98 by a pin 99. The table 52 has a third cylinder 106 having an extendable piston 108 which may be received in the bores 96 of the blocks 94 located beneath each of the bars 68. In operation the cylinder 98 is actuated in order to position the piston 100 in the bore 96 of a block 94, such that the cylinder 98 is releasably secured to the remainder of the rotatable table 52. Next, the cylinder 102 is actuated in order to extend the piston 104, and move the cylinder 98 and remainder of the table 52 rotatably about the shaft 72. When the piston 104 is fully extended from the cylinder 102, the cylinder 106 is actuated in order to position the piston 108 in the bore 96 of a block 94, and lock the table 52 in position. Next, the cylinder 98 retracts the piston 100 from the block 94, and the cylinder 102 retracts the piston 104 in order to position the cylinder 98 for placement in the next block 94 for further indexing of the table 52. In the event that the table 52 retains twelve trays 76, as shown in FIG. 10, the table 52 is only indexed once in order to position consecutive trays 76 into position for processing of the associated folded sleeves S'. In the event that the table 52 retains six trays 78, as shown in FIG. 11, the table 52 is indexed twice in succession by the respective cylinders in order to place consecutive trays in position for processing of the associated unfolded sleeves S. With reference to FIG. 8, the table 52 has an annular encoder 112 secured to the sleeve 70 with data on the encoder 112 being interpreted by a reading device 114. The data placed on the encoder 112 is determined by a central processing unit (CPU), and indicates the type of tray 76 or 78 located on the table 52 in order to determine whether to index the table 52 once or twice for placement of the associated trays in their proper position for processing of the respective sleeves. As shown in FIGS. 8 and 9, the table 52 has an outwardly directed plate 116 which is mounted on the shaft 72 through suitable bearings 118*a* and 118*b*, with the plate supporting a sleeve 101 for the piston 100. The pin 99 is secured to a bracket 103 which extends from a plate 105, with the plate 105 being secured to the plate 116.

With reference to FIGS. 7, and 31–35, the table has a tray elevating device 53 having a pair of spaced generally parallel vertical shafts 120 and 122 secured generally parallel to a plate 124. The tray elevating device 53 has a second plate 126 having a pair of opposed outwardly directed bearings 128 on each side of the plate 126 and slidably mounted on the shafts 120 and 122. The tray elevating device 53 has an internally threaded ball nut 130 secured to the plate 126, and a threaded shaft 132 rotatably mounted on the plate 124 by a pair of spaced bearings 125 and received in the ball nut 130. The shaft 132 has a pulley 134 secured to a lower end of the shaft 132, such that rotational movement of the pulley 134 by a suitable belt 135 and associated shaft 132 causes respective upward or downward movement of the ball nut 130 and plate 126, with the belt 135 being driven by a motor 139 at a fast speed and a slower speed in order to raise and lower the ball nut 130 and plate 126 at a fast or slow speed.

The tray elevating device 53 has a cylinder 136 secured by a pin 137 to a pair of spaced flanges 138 fixed to the plate 126. The cylinder 136 has an extendable piston 140 attached to a pair of spaced vertical rods 142 and 144 by a connecting member 146 extending between the rods 142 and 144 and secured to the piston 140 by a suitable bolt 148. The rods 142 and 144 are secured to a retaining member 150 having a pair of cross bars 152 and 154, with the bars 152 and 154 each having a pair of magnets 156 located adjacent outer opposed ends of the bars 152 and 154. The magnets 156 are located at a proper position on the retaining member 150 to releasably contact the plates 92 on the bottom of the trays 76 or 78 in order to releasably retain the plates 76 or 78 on the retaining members 150.

In operation, the table 52 is rotatably indexed to the desired position, and the pulley 134 is rotated by a suitable belt in order to position the ball nut 130 and associated plate 126 at a desired vertical position and contact a tray 76 or 78 by the retaining member 150 in order to releasably attach the tray 76 or 78 to the retaining member 150. During use, as will be further discussed below, when the cylinder 136 is actuated, the piston 140 extends a predetermined distance, such as 1½ inches, from the cylinder 136 in order to move the trays 76 or 78 the predetermined distance vertically in the table 52.

With reference to FIGS. 14–17, and 24–27, the sleeve loader 50 has a pair of spaced elongated rods 160 and 162, and the gripper finger carriage 56 has a pair of spaced bearings 164 and 166 secured to a side of a plate 168 and slidably received on the rod 160, and a bearing 170 secured to the other side of the plate 168 and slidably received on the rod 162. The sleeve loader 50 also has an elongated cylinder 172 for moving the gripper finger carriage 56 longitudinally along the rods 160 and 162. The sleeve loader 50 also has an elongated linear scale or encoder 174 of known type, and the gripper finger carriage 56 has an optical reading device 176 to determine the position of the gripper finger carriage 56 longitudinally along the scale 174.

The gripper finger carriage 56 has a second plate 178 beneath the first plate 168 having a generally triangular shaped portion.

With reference to FIGS. 24–27, the gripper finger carriage 56 has a second plate 178 located beneath the plate 168, and having a generally triangular shaped first portion 180 and an arcuate flange 182 extending from a side of the first portion 180. The first portion 180 and flange 182 have an outer curved edge 184 extending between one side edge 186 of the first portion 180 and an outer end 190 of the flange 182. The first portion 180 has a plurality of openings 192 extending along a curved line and generally aligned with the edge 184, and the flange 182 has a plurality of openings 194 extending along a curved line and generally aligned with the edge 184. The gripper finger carriage 56 has first and second locking members 196*a* and 196*b* with respective upper flanges 198 disposed over the second plate 178, and a ball 201 biased by a spring in a detent of the flange 198. The balls 201 are received in the openings 192 and 194 in order to define locking positions for the locking members 196*a* and *b*. The locking members 196*a* and *b* have a lower flange 203 disposed below the second plate 178, and a circular disc 205 engaging a lip 200. The locking members 196*a* and *b* have a cam lever 204 pivotally mounted by a pin 207, with the cam lever 204 having an eccentric, and with the cam lever 204 connected to the disc 205 by a bolt 202. When the cam lever 204 is moved to a lower position, the eccentric on the cam lever 204 causes inner movement of the disc 205, and compression against the lip 200 in order to lock the locking member 196*a* or *b* in place with the associated ball 201 located in the selected openings 192 or 194. One of the locking members 198*a* is locked to the first portion 180, and the other locking member 198*b* is locked to the flange 182. When locked, the locking members 196*a* and *b* are disposed at angles relative a center line l drawn from a pivot point 206 toward a guide member 208, with the locking members 196*a* and *b* preferably disposed at the same angle on opposed sides of the center line l.

The guide member 208 has a pair of spaced rollers 210 and 212 rotatably mounted on a plate 214 of a gripper assembly 216, such that the gripper assembly 216 may be moved along the second plate 178 with the rollers 210 and 212 rotating during movement of the gripper assembly 216. The gripper finger carriage 56 has a cylinder 218 having a piston 220 connected to a vertical plate 228 which is connected to a plate 222, with the plate 222 extending between the piston 220 and plate 214 of the gripper assembly 216. The gripper finger carriage 56 has a sleeve 224 pivotally mounted on a shaft 226 secured to the plate 178, such that the gripper assembly 216 pivots about the pivot point 206 extending centrally along the shaft 226. The plate 222 is secured to the shaft 226 by the vertical plate 228 which extends between the shaft 226 and the plate 222. The gripper assembly 216 has a plurality of spaced pick up fingers 230 of known type secured to the plate 222 and disposed longitudinally along the plate 222. The plate 178 has a downwardly extending end plate 232 with a separate pick up finger 234 secured to an angled portion 236 of the plate 232.

The cylinder 218 is actuated to extend the piston 220 and rotate the gripper assembly 216 about the shaft 226 until the plate 214 engages against the locking member 196*a*. At the same time, the pick up fingers 230 are rotated to an angular position A relative to the center line l above the sleeves S' or S of FIGS. 12 and 13 as shown by the lines L1 extending along the edges E2 of the sleeves S' and S, while the pick up finger 234 is disposed at a fixed 90 degree angle relative to the center line l, such that the pick up finger 234 is located along a line L2 adjacent an inner edge E3 of the sleeves S' and S.

Figure 28:
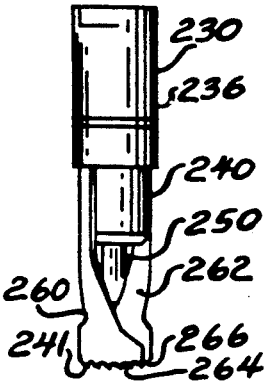
FIG. 28 is an elevational view of a pick up finger for use in the gripper finger carriage of the present invention.
Figure 29:
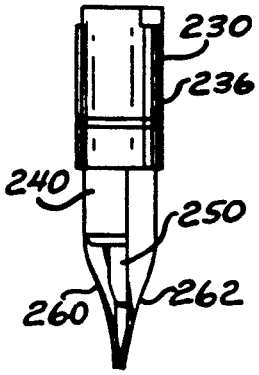
FIG. 29 is an elevational view of the pick up finger, taken partly in section, in a rotated position relative to FIG. 28.
Figure 30:
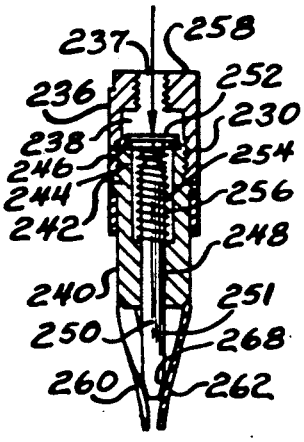
FIG. 30 is a sectional view of the pick up finger of FIGS. 28 and 29.

The pick up fingers 230 are described in connection with FIGS. 28–30 as follows, with an end pick up finger 234 operating in the same manner as the pick up fingers 230. Each pick up finger 230 has a cylindrical member 236 defining a cavity 238, and having a passageway 237 communicating with the cavity 238 at an end of the cylindrical member 236. The pick up finger 230 has an elongated guide member 240 secured by outer threads 242 on a proximal annular flange 244 to inner distal threads 246 of the cylindrical member 236. The guide member 240 has a bore 248 extending therethrough to slidably receive a plunger 250 having an enlarged head 252 secured to a proximal end of the plunger 250. The guide member 240 has a central channel 254 at a proximal end to receive a helical spring 256 extending between a distal end of the channel 254 and the head 252 of the plunger 250 in order to bias the plunger 250 toward a proximal end 258 of the pick up finger 230. The pick up finger 230 has a pair of opposed fingers 260 and 262 extending from the guide member 240, and having respective distal serrations 264 and 266, with distal ends of the fingers 260 and 262 being resiliently biased toward each other to a closed position. However, when desired, air is passed into the cavity 238 against the head 252 in order to move a distal end 268 of the plunger 250 against inner sides of the fingers 260 and 262 and to move the fingers 260 and 262 to a spaced configuration and open the fingers 260 and 262, as shown in FIG. 30, with distal ends of the fingers 260 and 262 being moved laterally when being opened. Thus, the plunger 250 is normally biased to the proximal position by the spring 256 in order to permit the fingers 260 and 262 to close, while the distal ends of the fingers 260 and 262 move laterally, but air may be passed into the cavity 238 in order to move the plunger 250 against the fingers 260 and 262 and open the fingers 260 and 262, with passage of air into the cavity 238 of the pick up fingers 230 being controlled by the central processing unit and a valve 239 shown in FIG. 26.

The plate 214 has a plurality of switches 270, such as four switches, in order to inactivate the outer four respective pick up fingers 230 disposed along the plate 222 relative to the shaft 226 as controlled by the central processing unit. The gripper finger carriage 56 has an upper cylinder 272 secured to the plate 178, with the cylinder 272 having a piston 273 secured to the plate 168, such that the gripper assembly 216 and associated pick up fingers 230, as well as the pick up finger 234, may be moved in a vertical direction by the cylinder 272. The gripper finger carriage 56 has a yoke 274 secured to the plate 168, and an elongated encoder 276 with coded openings which are read by reading devices in the yoke 274, as indicated to the central processing unit, with the encoder 276 being secured to the plate 222.

In operation, after rotation of the gripper assembly 216 to the desired angular position A by the cylinder 218 as selected by the operator and controlled by the central processing unit, the cylinder 272 is actuated by the central processing unit and lowers the pick up fingers 230 into position above a stack of sleeves S or S' during which the pick up fingers 230 and 234 are opened by the passage of air against the plungers 250, as controlled by the central processing unit, and the pick up fingers 230 are placed against the uppermost sleeve S or S' in the open configuration of the pick up fingers 230 after which the passage of air is terminated to the plungers 250, and distal end of the fingers 260 and 262 are closed against the sleeve S or S', with the distal end of the fingers 260 and 262 shifting laterally in order to snag threads of the sleeve rather than pinch the sleeve and pick up only one ply or sleeve. As will be further discussed below, the cylinder 272 is then actuated by the central processing unit in order to raise the sleeve S or S'. The pick up finger 234 is placed at a fixed rotated position relative to the pick up fingers 230 in order to prevent wrapping of the sleeves S or S' about the pick up fingers which could otherwise occur if the pick up fingers 230 and 234 were aligned. A sensor 235 in the cylinder 272 indicates to the central processing unit when the gripper finger carriage 56 is in a lower and raised position. Further operation of the gripper finger carriage 56 in connection with the flutter finger carriage 54 will be discussed below.

With reference to FIGS. 1, 4, 14, and 18–21, the flutter finger carriage 54 has an upper plate 280 with a pair of spaced bearings 282 and 284 slidably received on the rod 160, and a pair of spaced bearings 286 and 288 slidably received on the rod 162. The sleeve loader 50 has a cylinder 290 for moving the flutter finger carriage 54 longitudinally along the rods 160 and 162. The sleeve loader 50 has an elongated scale or encoder 292 of known type, such as 7 mil. Kodak Ultraline film, sold by P. C. Designs, which are read by suitable reading devices 293 on the flutter finger carriage 54 in order to determine the position of the flutter finger carriage 54 longitudinally along the rods 160 and 162.

The flutter finger carriage 54 has a first plate 294 having a plurality of aligned openings 296 disposed in an arcuate pattern along an outer edge 298 of the plate 294. The plate 294 has an arcuate opening 300 extending substantially between adjacent sides 301 and 303 of the plate 294. The flutter finger carriage 54 has a second plate 302 disposed below the first plate 294, and having a plurality of upper guides 304 with central slots 306 to receive opposed edges 305 and 307 of the plate 294 extending along the opening 300, such that the plate 302 may slide along the opening 300 with the guides 304 guiding movement of the plate 302. The flutter finger carriage 54 has a shaft 308 secured at a fixed position to the plate 302. The plate 302 has an annular member 310 retaining a ball 312, with the ball 312 being biased outwardly by a helical spring 314 in a cavity 316 of the member 310, such that the spring 314 biases the ball 312 against lower tapered portions of the openings 296. The flutter finger carriage 54 has a bar 318 extending outwardly from the shaft 308, and a cylinder 320 is secured to an outer end of the bar 318 beneath the bar 318. The cylinder 320 has a piston 322, and a plunger 324 secured to an outer end of the piston 322. During use, a button 326 of the flutter finger carriage 54 is pushed which causes actuation of the cylinder 320 by the central processing unit, and retracts the plunger 324 from upper tapered portions of the openings 296. The flutter finger carriage 54 has an elongated arcuate encoder strip 328 with suitable openings which is disposed above the plate 294. The encoder strip 328 is located between opposed plates of an encoder 330 which has reading devices which are capable of reading the openings in the encoder strip 328, as indicated to the central processing unit, with the encoder 330 having an indicator light 332.

The flutter finger carriage 54 has a cylinder 334 with a piston 336 connected to an elongated angular plate 338 adjacent one end 340 of the plate 338. The flutter finger carriage 54 has a rod 342 secured to the other end 344 of the plate 338, and slidably received in a pair of spaced bearings 346 and 348 secured to the plate 294. The flutter finger carriage 54 has a plurality of spaced flutter fingers 350 extending from a block 352 secured to a lower surface of the plate 338. The flutter fingers 350 have a hollow tubular section 354 with an inner straight portion 356 extending from the block 352, and an outer downwardly extending portion 358. The flutter fingers 350 have a flange 360 received on the tubular section 354 with one end 362 having an aperture and being received on the inner portion 356, and a second end 364 having an aperture and being received on the outer portion 358 of the tubular section 354. The flutter fingers 350 have lower hollow end portions 366 communicating with the outer portions 358 with an orifice 368 in an outer wall to guide the passage of air along the lower surface of the second end 364 of the flange 360. The cylinder 334 may be actuated by the central processing unit to extend the piston 336, and move the flutter fingers 350 between inner and outer positions relative to the plate 294. The flutter finger carriage 54 has a second plate 370 extending from a forward edge 372 of the plate 294. The second plate 370 has a plurality of laterally disposed cylinders 374 inclined slightly from the vertical and secured to the plate 370, with the cylinders 374 being disposed intermediate adjacent flutter fingers 350. The cylinders 374 have associated pistons with outer hold down fingers 376 actuated by the cylinders 374. The flutter finger carriage 54 has a plurality of switches 378 which may be utilized to inhibit operation of a plurality of hold down fingers 376 by the central processing unit through the cylinders 374 in order that the hold down fingers 376 which are inhibited do not disturb an edge of the sleeve stack.

In use, the button 326 is pressed in order to actuate the cylinder 320, and lift the plunger 324 from the openings 296. The plate 294 is then rotated relative to the plunger 324 and ball 312 while the encoder 330 indicates whether the code of the strip 328 matches the code of the selected angle A of the gripper assembly 216 of the gripper finger carriage 56 as determined by the encoder 276 and the central processing unit, such that the angle assumed by the pick up fingers 230 of the gripper finger carriage 56 is the same as the angle assumed by the flutter fingers 350. At this time, the button 326 is released, and the cylinder 320 is actuated in order to position the plunger 324 in the associated opening 296 of the plate 294 and lock the plate 294 at the desired position with the angle of the flutter fingers 350 and hold down fingers 376 being the same as the angle of the pick up fingers 230.

The flutter finger carriage 54 has a vertical cylinder 380 with a piston 382 connected to a lever arm 384 which is pivotally mounted about a pin 386. A flutter finger 350' of the same construction as the flutter fingers 350 previously described is attached to an outer end 388 of the lever arm 384. An inner end 387 of the lever arm 384 has a pin 390 pivotally connected to an outer end of the piston 382. Thus, when the cylinder 380 is actuated and the piston 382 is extended, the lever arm 384 rotates about the pin 386, and lifts the flutter finger 350', as indicated by dotted lines in FIG. 21. When the cylinder 380 is actuated in order to retract the piston 382, the lever arm 384 is pivoted about the pin 386 in order to move the flutter finger 350' to a lower position as indicated by solid lines in FIG. 21. The flutter finger carriage 54 also has a vertical cylinder 392 with a lower piston or hold down finger 394 which is actuated by the cylinder 392. Both the cylinder 380 with associated flutter finger 350' and cylinder 392 are located at a fixed position, and do not rotate with the plate 294.

In operation, initially, the flutter finger carriage 54 is moved by its associated cylinder 290 in a right-hand direction, as viewed in FIGS. 1 and 4, until a sensor 400 positioned on the sleeve loader 50 and monitored by the central processing unit indicates that the flutter finger carriage 54 is located at the desired home position. In turn, once the flutter finger carriage 54 is located at the home position, the gripper finger carriage 56 is permitted to move in the right-hand direction, as viewed in FIGS. 1 and 4, until a sensor 402 indicates to the central processing unit that the gripper finger carriage 56 is located at the desired position. Next, the cylinder 218 of the gripper finger carriage 56 moves the gripper assembly 216 in a direction engaging against the locking member 196*b* until the pick up fingers 230 of the gripper assembly 210 is positioned at the angle A selected by the operator. The operator then presses the button 326 of the flutter finger carriage 54, and moves the plate 294 to the desired angle as determined by the encoder 274 of the gripper finger carriage 56 which is signaled to the encoder 330 of the flutter finger carriage 54 by the central processing unit at which time the button 326 is released in order to lock the plate 294 and associated flutter fingers 350 by the plunger 324 at the same angle as the pick up fingers 230. From the home position, the gripper finger carriage 56 is then moved in a left-hand direction, as viewed in FIGS. 1 and 4, until reading of a sensor 404, which detects the reflective strips 80 and 84 on the trays 76 and 78, respectively, is interrupted by a stack of sleeves located over the strips on the trays 76 or 78. Next, the gripper finger carriage 56 is moved in a reverse direction one count, as indicated by the linear scale 174 for the gripper finger carriage 54 in a configuration with the pick up fingers 230 and 234 at a proper position for pick up over an edge of the sleeves S or S'. Next, the flutter finger carriage 54 is moved by the cylinder 290 towards the gripper finger carriage 56 until the scale 292 for the flutter finger carriage 54 indicates that it is at a correct position relative to the gripper finger carriage 56, as determined from information obtained from the scale 174 for the gripper finger carriage 54 by the central processing unit and indicated to the scale 292 for the flutter finger carriage 54. In this configuration, the flutter finger carriage 54 is located at a proper position relative to the gripper finger carriage 56, and the pick up fingers 230 and 234 are located at the proper angle relative to the angle of the flutter fingers 350 and hold down fingers 376. In this configuration, the pick up fingers 230 are located along the line L1, as shown in FIGS. 12 and 13, and the pick up finger 234 is located along the line L2, as shown in FIGS. 12 and 13, irrespective of whether the sleeves S or S' are folded or unfolded, with the pick up fingers 230 being located approximately one inch from the edge E2 of the sleeves S or S'.

Next, the pulley 134 is rotated by the belt 135 at the fast speed in order to move the ball nut 130 and plate 126 in an upper vertical direction, and the piston 140 of the cylinder 136 is extended until a sensor 408*a* on one side of the sleeve loader 50 and a sensor 406 on the other side of the sleeve loader 50 detect the top of the sleeve stack at which time the pulley 134 is rotated at the slow speed. The pulley 134 is moved at the slow speed in order to position the associated trays 76 or 78 secured to the retaining member 150 at the proper height which is determined by the sensor 406 and a sensor 408*b* on the other side of the sleeve loader 50, which detects the top of the sleeve stack, at which time upper movement of the sleeve stack is terminated with the top of the sleeves located at the correct height for subsequent pick up.

Figure 18:
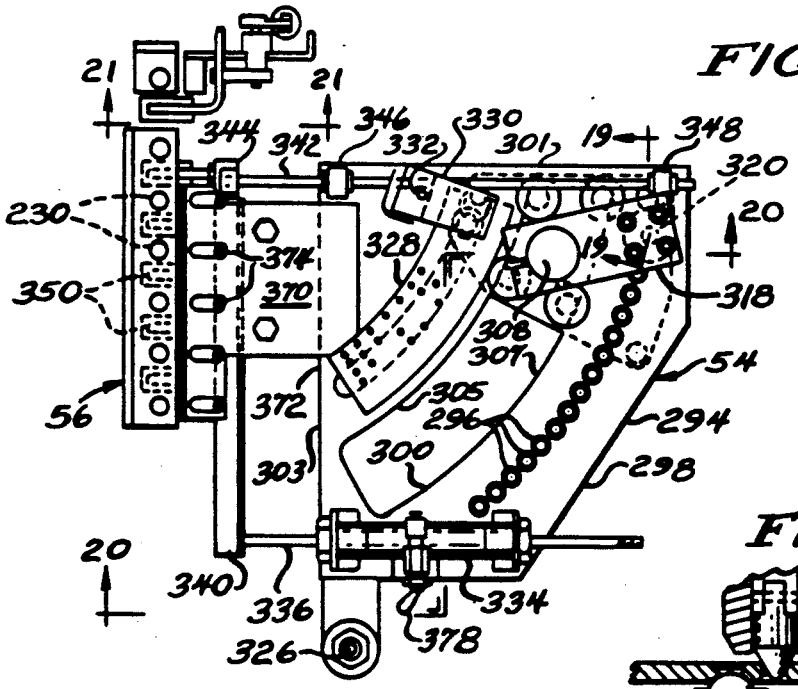
FIG. 18 is a top plan view of a flutter finger carriage according to the present invention.
Figure 19:
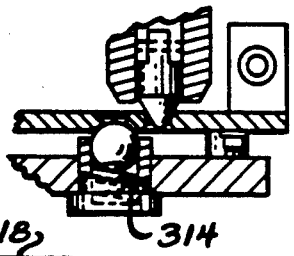
FIG. 19 is a fragmentary sectional view taken substantially as indicated along the line 19—19 of FIG. 18.
Figure 20:
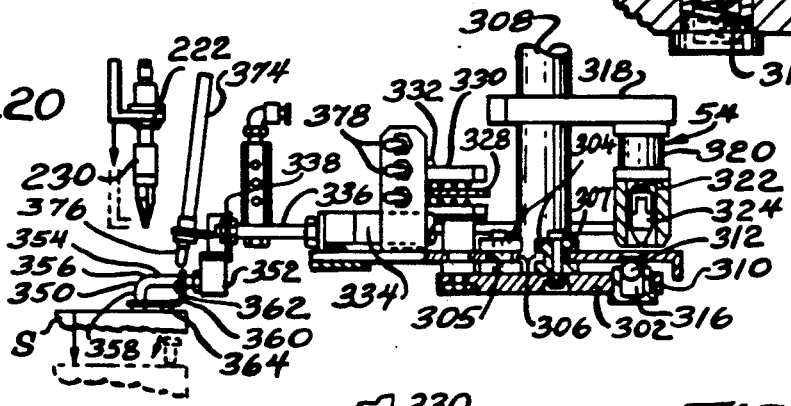
FIG. 20 is an elevational view, partly in section, taken substantially as indicated along the line 20—20 of FIG. 18.
Figure 21:
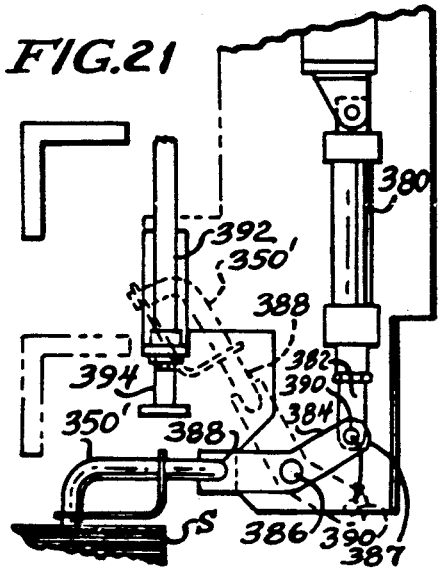
FIG. 21 is an elevational view taken substantially as indicated along the line 21—21 of FIG. 18.
Figure 26:
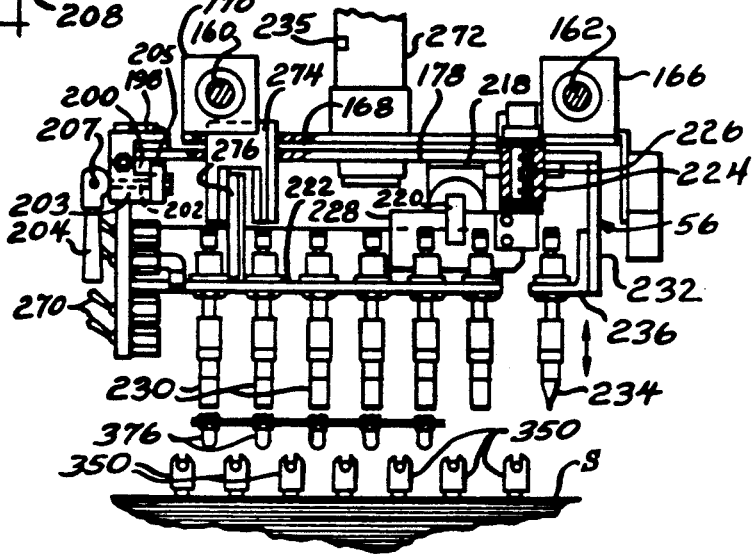
FIG. 26 is an elevational view, partly in section, taken substantially as indicated along the line 26—26 of FIG. 24.

Next, the piston 140 of the cylinder 136 is retracted in order to lower the stack of sleeves on the associated tray a predetermined amount, such as 1½ inches, before any of the sleeves are picked up. At this time, the cylinder 334 of the flutter finger carriage 54 is actuated in order to extend the piston 336 and locate the flutter fingers 350 at the proper position between the pick up fingers 230 of the gripper finger carriage 56, and the stationery flutter finger 350' is subsequently located intermediate the stationery pick up finger 234 and the pick up fingers 230, as shown in FIGS. 18, 20 and 26, with the lowered cloth stack permitting movement of the flutter fingers 350 into this configuration over the sleeves. At this time, the air is connected to the flutter fingers 350 and 350' in order to permit passage of the air through the orifices 368 associated with the flutter fingers 350. Next, the tray and associated sleeve stack beneath the gripper fingers 230 and flutter fingers 350 and 350' is raised by the cylinder 136 and pulley 134 to place the top of the sleeve stack at the proper position, as determined by the sensors 406 and 408. In this configuration, as shown in FIG. 22, the air from the flutter fingers 350 and 350' pass through the associated orifices 368 along the top of the sleeves in order to create a vacuum beneath the second end 64 of the plate or flange 360, termed a Coanda effect, and lift an edge of the sleeve to effect separation from a lower ply of the sleeves, whether folded or unfolded.

Figure 22:
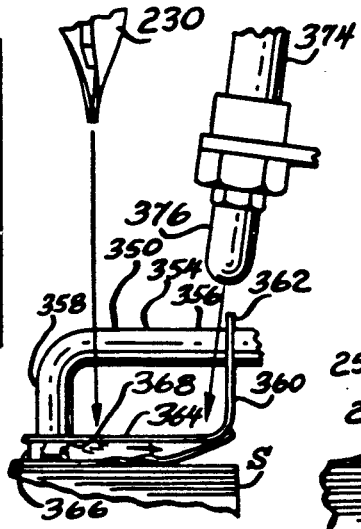
FIGS. 22 and 23 are elevational views illustrating use of flutter fingers, pick up fingers, and hold down fingers in connection with the processing of a stack of sleeves.

At this time, the cylinder 272 of the gripper finger carriage 56 is actuated in order to lower the gripper fingers 230 and 234 into position above the sleeves S or S', as shown in FIG. 22, while air is passed into the pick up fingers 230 in order to open the fingers 260 and 262 in preparation for pick up of the sleeve. As previously discussed, the distal ends of the fingers 260 and 262 of the pick up fingers 230 are moved in a lateral direction when the fingers 260 and 262 are open, and when the pick up fingers 230 and 234, are located at the correct position above the sleeves S or S', the air is removed from the pick up fingers 230 and 234, such that the fingers 260 and 262 are closed, with the distal ends of the fingers 260 and 262 moving sideways relative to each other in order to snag a few threads of the sleeve rather than pinch the sleeve such that the fingers pick up only one ply of the sleeve, whether folded or unfolded, as previously discussed. The sensor 235 in the cylinder 272 of the gripper finger carriage 56 indicates when the pick up fingers 230 and 234 are located at the correct position above the sleeves.

Once the pick up fingers 230 and 234 are closed and retain the top ply of the sleeves S or S', the cylinder 334 is actuated to retract the flutter fingers 350. Normally, the flutter finger carriage 54 remains stationery. However, when a new stack is moved into position, the flutter finger carriage 54 is moved in the right-hand direction, as viewed in FIGS. 1 and 4, until the sensor 400 indicates that the flutter finger carriage 54 is located at the home position.

Figure 23:
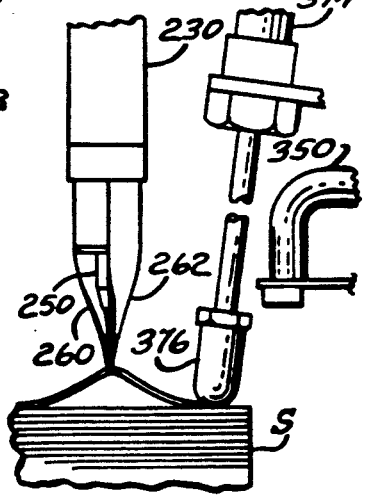
Figure 24:
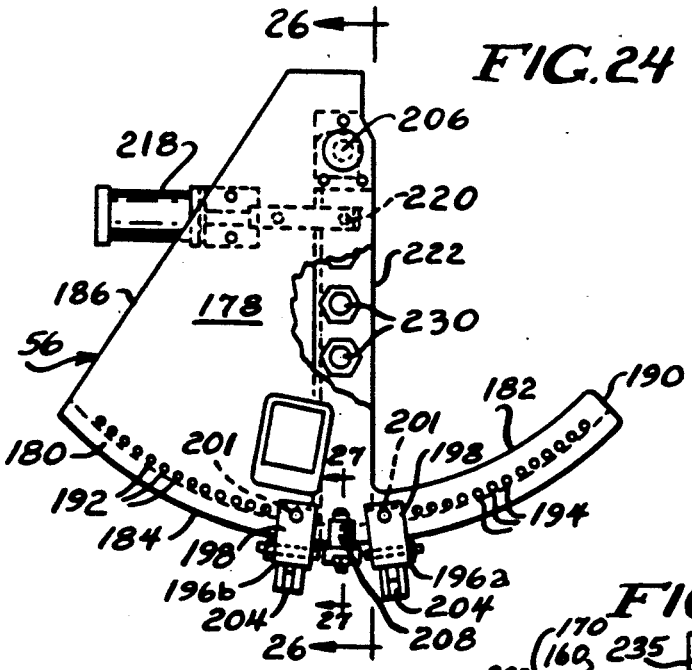
FIG. 24 is a top plan view, partly broken away, of a gripper finger carriage according to the present invention.
Figure 25:
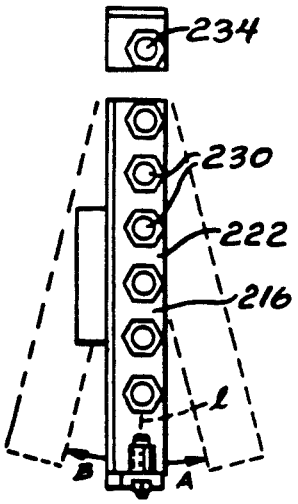
FIG. 25 is a top plan view of a gripper assembly of the gripper finger carriage of FIG. 24.
Figure 27:
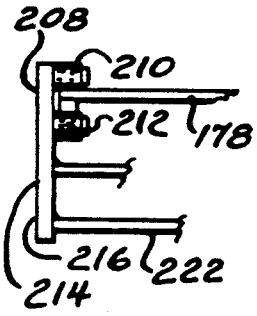
FIG. 27 is a fragmentary elevational view, taken substantially as indicated along the line 27—27 of FIG. 24.

At this time, the cylinders 374 and 392 are actuated in order to place the hold down fingers 376 and 394 in position on top of the sleeve ply beneath the lifted sleeve ply, as shown in FIG. 23, and apply pressure to the lower ply of the sleeve if the sleeve is folded, or to the next lower sleeve if the sleeve is unfolded. The gripper finger carriage 56 is lifted by the cylinder 272 in this manner until the sensor 235 in the cylinder 272 indicates that the gripper finger carriage 56 is located at a desired upper position.

At this time, the cylinder 136 of the table 52 is actuated in order to lower the tray and associated stack the predetermined distance while the pick up fingers 230 and 234 retain the top sleeve ply, and the cylinder 272 of the gripper finger carriage 56 is actuated in order to lift the gripper assembly 216 and pick up fingers 230 and 234 and further separate the top sleeve ply. Next, the cylinder 218 of the gripper finger carriage 56 is actuated in order to move the gripper assembly 216 against the locking member 196*b* and the associated pick up fingers 230 to the angle B on the opposed side of the center line l, and in an appropriate form the angle B is normally the same on the left-hand side of the center line l, as viewed in FIGS. 24 and 25, as the angle A on the right-hand side of the center line l, such that the front edge of the sleeve does not fold over when it is dropped off subsequently by the gripper finger carriage 56. During this time, the sleeve S or S' is further unfolded by the pick up fingers 230 and 234 in preparation for movement of the sleeve by the gripper finger carriage 56.

With reference to FIGS. 1 and 36–38, the sleeve loader 50 has a main flutter assembly 410 for use in connection with the folded sleeves S'. The main flutter assembly 410 has a lower plate 412 and a spaced upper plate 414 defining a chamber 416 between the plates 412 and 414. The sleeve loader 50 has a blower 418 which is connected through a conduit 420 to a diverter valve 422 to control the passage of air from the blower 418. The diverter valve 422 may be actuated to permit passage of the air through a conduit 424 and an opening 426 in the lower plate 412 into the chamber 416. The flutter assembly 410 has a lower circular plate 428 rotatably mounted about a shaft 432 in a circular opening 430 of the lower plate 412. The plate 428 has an upwardly directed annular flange 434 defining an opening 436 communicating with the chamber 416. The plate 428 has a circular gear 438 which is rotatable about the shaft 432. The main flutter assembly 410 also has a second gear 440 secured to a plate 441 which are rotatable about a shaft 442, with the plate 441 having a side portion 444 extending through an opening 446 in a side wall 448 of the main flutter assembly 410. As shown, an endless chain 450 passes around the gears 438 and 440, such that rotation of the side portion 444 of plate 441 imparts rotational movement to the gear 438 and associated plate 428 in order to position the annular flange 434 and associated opening 436 at a desired angular position above the folded sleeves S'. In this configuration, air passes from the chamber 416 through the opening 436 in order to direct air onto the folded sleeves S' in all directions 360 degrees around the opening 436 and create a vacuum, again termed a Coanda effect, and separate a back part of the sleeves S'. The main flutter assembly 410 is operated at the same time as the flutter fingers 350 and 350' of the flutter finger carriage 54. Also, the blower 418 may be operated to select the amount of air passing through the opening 436 dependent upon the size of the sleeve S'. The location of the annular flange 434 and associated opening 436 is selected by the side portion 444 of the plate 441 at a rotational angle dependent upon the style and material of the sleeves S'.

Figure 36:
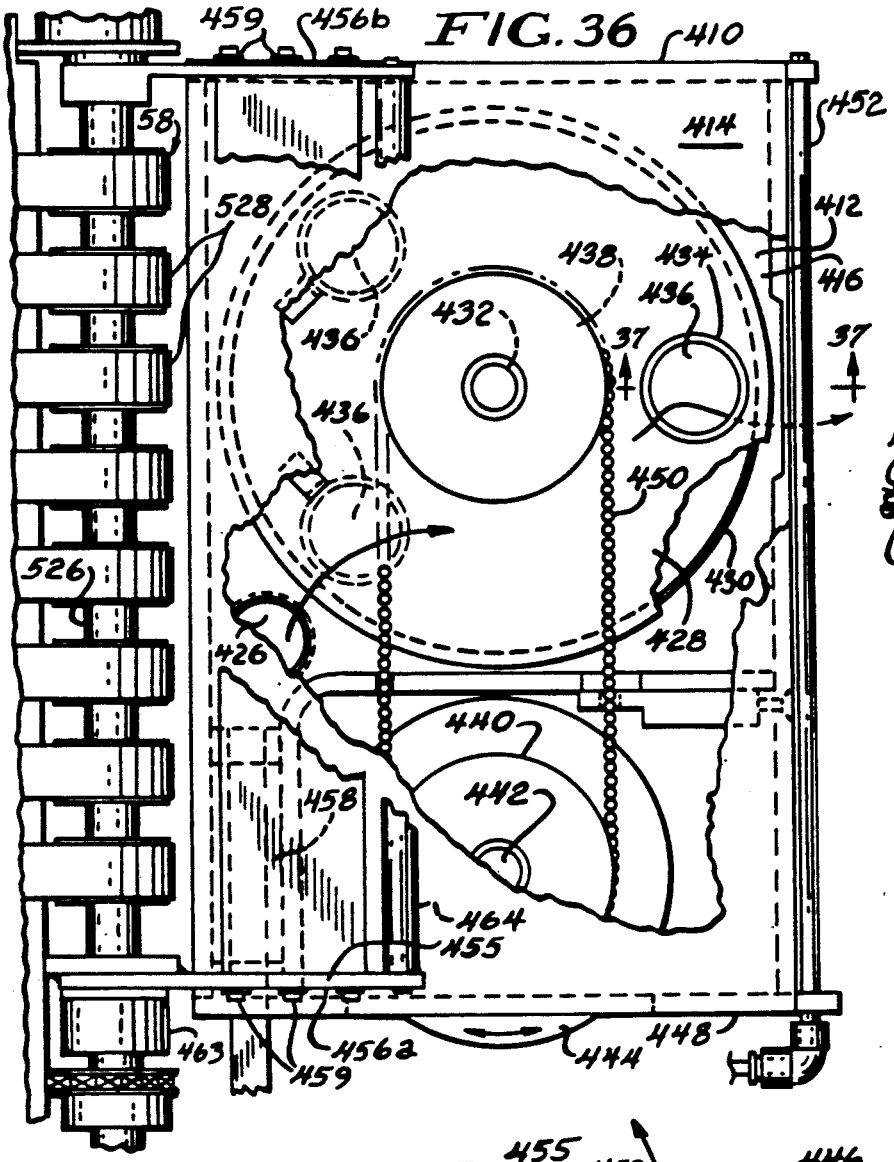
FIG. 36 is a top plan view, partly broken away, of a main flutter assembly according to the present invention.
Figure 37:
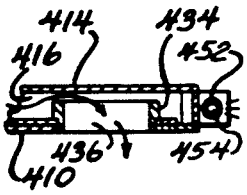
FIG. 37 is a fragmentary sectional view taken substantially as indicated along the line 37—37 of FIG. 36.
Figure 38:
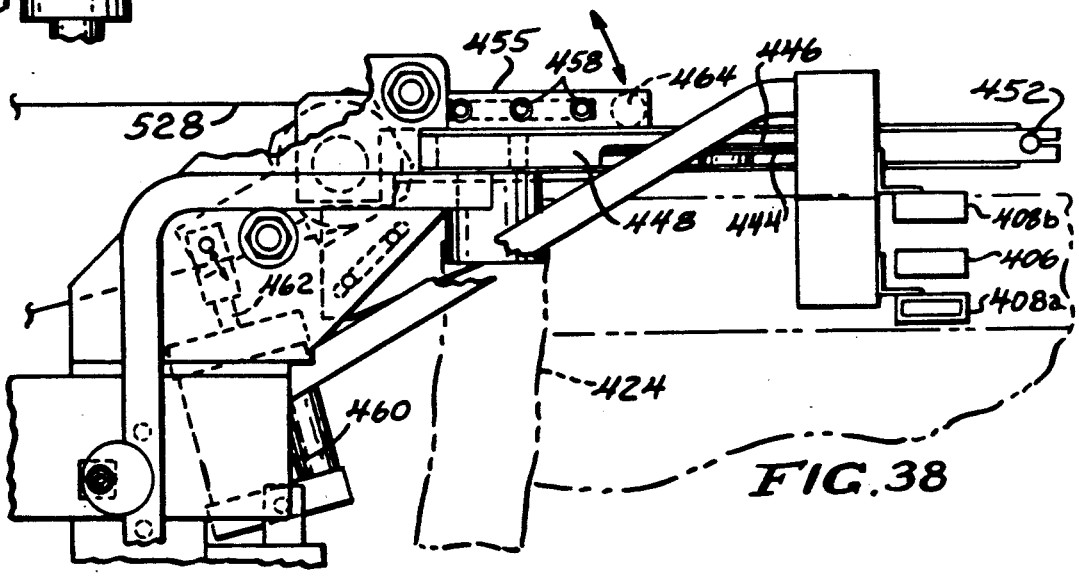
FIG. 38 is a fragmentary elevational view taken from a side of the main flutter assembly as shown in FIG. 36.

As shown in FIGS. 36 and 38, the sleeve loader 50 has an elongated conduit 452 extending laterally across the sleeve loader 50 at a location forwardly of the main flutter assembly 410. The conduit 452 has a plurality of openings 454 spaced longitudinally along the conduit 452, and the conduit 452 is connected to a source of air to permit passage of the air through the conduit 452 and openings 454 onto the upper ply of the sleeves S or S' in order to prevent a folded over edge of the sleeve S or S'.

With reference to FIGS. 36 and 38, the sleeve loader 50 has a hold down assembly 455 having a pair of end plates 456*a* and 456*b* which are secured to plate 458 extending laterally across the sleeve loader 50 between the plates 456*a* and *b* and secured in place by a plurality of screws 459. The sleeve loader 50 has a cylinder 460 with a piston 462 which rotates a bearing 463 secured to the plate 456*a* in order to cause movement of the hold down assembly 455 between an upper position spaced from the sleeves, and a lower position engaging against an upper surface of the sleeves. The hold down assembly 455 has a plurality of rollers 464 extending laterally across the sleeve loader 50 between the plates 456*a* and *b*. The cylinder 460 may be actuated in order to lower the roller 464 onto the rear portion of the stack of unfolded sleeves S with the main flutter assembly 410 removed, and hold the rear portion of the sleeves S down by the hold down assembly 455.

With reference to FIGS. 1–4, the sleeve loader 50 has a bar 470 extending laterally across the sleeve loader 50, and a pair of spaced support members 472*a* and 472*b* depending from the bar 470, with an elongated rod 474 being secured to and extending between the support members 472*a* and *b*.

The sleeve loader 50 has a second bar 476 extending laterally across the sleeve loader 50, and having a pair of spaced support members 478*a* and 478*b* depending from the bar 476, with an elongated rod 480 being secured to and extending between the support members 478*a* and 478*b*.

The sleeve loader 50 has a carriage assembly 482 comprising the flutter finger carriage 54 and gripper finger carriage 56. The carriage assembly 482 has a pair of spaced upstanding bearings 484*a* and 484*b* which are slidably received on the rod 474 adjacent one end of the carriage assembly 482. The carriage assembly 482 also has an upstanding bearing member 486 having a pair of spaced bearings 488*a* and 488*b* slidably received on the rod 480 adjacent the other end of the carriage assembly 482 and adjacent one side of the carriage assembly 482. The carriage assembly 482 has a cylinder 490 which has a piston which actuates a brake member 492 to close a pair of split blocks in order to lock one end portion of the carriage assembly 482 in place on the rod 474. The carriage assembly 482 also has a cylinder 494 which has a piston which actuates a second brake member 496 to close a pair of split blocks on the rod 480 in order to lock the other end portion of the carriage assembly 482 on the rod 480. The cylinders 490 and 494 are actuated by a suitable switch in order to control the brake members 492 and 496 and lock the carriage assembly 482 at a desired lateral position on the rods 474 and 480.

In operation, the cylinders 490 and 494 may be actuated in order to release the brake members 492 and 496 and move the carriage assembly 482 between a first operative position above the sleeve stack, and a second position toward a side of the sleeve loader 50 for purpose of service and adjustment of the carriage assembly 482. Of course, the carriage assembly 482 may be locked in either the first or second positions by the cylinders 490 and 494.

With reference to FIGS. 1 and 4, the sleeve loader 50 has a drive motor 498 having a drive pulley 500 rotatably engaging against and driving an endless belt 502 which is received on a pulley 504, with the sleeve loader 50 having a tensioner 506 applying tension to the belt 502. The alignment assembly 60 has a pair of spaced rotatable shafts 508 and 510 extending laterally across the sleeve loader 50, with an endless relatively wide belt 512 extending across the alignment assembly 60 and passing around the shafts 508 and 510, and with a tensioner 514 applying tension to the belt 512. In this configuration, the shaft 508 is driven by the pulley 504 and associated drive motor 498 in order to drive the belt 512. The shaft 510 has a pulley 516, and the sleeve loader 50 has a rotatable shaft 518, with an endless belt 520 extending around the pulley 516 and shaft 518, with a tensioner 522 applying tension to the belt 520. Thus, the shaft 518 is driven by the pulley 516 through the belt 520.

The detection assembly 58 has a pair of rotatable shafts 524 and 526 extending laterally across the sleeve loader 50, and a plurality of endless belts 528 extending around the shafts 524 and 526. The sleeve loader 50 has an endless belt 530 extending around the shaft 518 and a shaft 526 in addition to a tensioner 532 which applies tension to the belt 530. The shaft 526 is driven by the belt 530 and shaft 518, such that the belts 528 are driven by the shaft 526. The sleeve loader 50 has an air reservoir 534 located below the detection assembly 58 for supplying air to the system.

At this time, the gripper finger cylinder 172 moves the gripper finger carriage 56 in a direction located over the detection assembly 58 while moving the retained sleeve over the belts 528. The flutter finger carriage 54 remains in place, and the flutter finger 350, and 350 are sequentially retracted with the piston 140 of the cylinder 136 retracted. The gripper finger carriage 56 is moved to a predetermined position as determined by the gripper finger scale 174 which is selected by the operator, at which time the gripper fingers 230 and 234 are opened in order to release the sleeve, whether folded or unfolded onto the belts 528. The position at which the gripper finger carriage 56 releases the sleeves is selected electronically from a control panel onto the linear scale or encoder 174. In this manner, the sleeve S or S' is turned over by the gripper finger carriage 56 and is released onto the detection assembly 58. Upon release of the sleeve onto the detection assembly 58, the gripper finger carriage 56 moves a predetermined distance after placement of the sleeve, as selected by the operator and determined by the scale 174 for the gripper finger carriage 56, in order to provide for continuity of momentum for the gripper finger carriage 56. At this time, the gripper finger carriage 56 is actuated by the associated cylinder 172 in order to reverse the direction of the gripper finger carriage 56, and move the gripper finger carriage 56 in the reverse direction towards the sleeve stack. At this time, the cylinder 218 of the gripper finger carriage 56 is actuated to reset the pick up fingers 230 of the gripper assembly 216 at the initial angle A adjacent the locking member 196*a*, in a manner as previously discussed. The gripper finger carriage 56 is moved by the associated cylinder 172 into position adjacent the edge of the sleeve on the stack of sleeves as determined by the scale 174 for the gripper finger carriage 56 as established by the central processing unit when the sleeve was initially picked up by the gripper finger carriage 56, and the flutter fingers 350 and 350' are again extended between the gripper fingers 230 and 234. The cylinder 136 is again extended and the pulley 134 is rotated to raise the ball nut 130 to position the stack of garments at the proper height, as determined by the sensors 408*b* and 406.

After a stack of garments has been completely processed on a tray 76 or 78, the cylinder 136 is retracted, and the pulley 134 is rotated at the fast speed in order to lower the retaining member 150. At this time, the table 52 is rotated or indexed in a manner, as previously discussed, and the operation is repeated in order to raise the retaining member 150 to the subsequent tray which has been retracted 76 or 78 for processing the subsequent stack of garments.

The sewing machine 64 can only sew the sleeves S or S' in the correct orientation with an inside of the sleeve S or S' facing up as it passes through the sewing machine 64.

In the case of initially folded sleeves S', after placement of the sleeves S' on the detection assembly 58, the sleeves S' when unfolded are located in the correct orientation for sewing by the sewing machine 64. Hence, in the case of the folded sleeves S', the belts 528 move the sleeves S' as unfolded toward the alignment assembly 60 with a control plate 540 located in an upper pass configuration as will be discussed further below in connection with FIGS. 39–42 in order to permit direct passage of the sleeves from the detection assembly 58 onto the alignment assembly 60 as best shown in FIG. 41. The determination of whether the processed sleeve is initially folded or unfolded is made by the central processing unit, which controls the configuration of the plate 540 in a manner as will be further described below.

With reference to FIGS. 1, 4, and 5, the alignment assembly 60 operates in the same manner whether the sleeves are flat or folded. The alignment assembly 60 has a blower sensor 542 which senses the passage of a sleeve on the belt 512 beneath the sensor 542. The alignment assembly 60 has a pair of elongated uncurler blowers 544 and 546 extending laterally over the belt 512, and connected to a source of air. Responsive to a delay set by the operator when the sensor 542 detects a sleeve beneath the sensor 542, the source of air is passed through the uncurler blowers 544 and 546 and a plurality of openings disposed longitudinally along the blowers 544 and 546 in opposed longitudinal directions, as indicated by the arrows shown in FIG. 1, in order to unfold opposed edges of the sleeve in the event that they are folded over.

The alignment assembly 60 has a coarse adjustment aligner 548, and a fine adjustment aligner 550. The coarse adjustment aligner 548 has a cylinder 552 which selectively rotates a sleeve 554 about a central axis of the cylinder 552, with an alignment wheel 556 being rotatably mounted to a shaft 558 extending through the sleeve 554, and with the wheel 556 being inclined at an angle to the edge against which it is to be aligned. The fine adjustment aligner 550 also has a cylinder 560 secured to a sleeve 562, and the cylinder 560 may selectively rotate the sleeve 562 about a central axis of the cylinder. The fine adjustment aligner 550 has an alignment wheel 564 rotatably mounted to a shaft 566 extending through the sleeve 562, with the wheel 564 being inclined at an angle to the edge 520 against which it is to be aligned. The course adjustment aligner 548 operates in a manner such that the cylinder 552 may selectively raise and lower the alignment wheel 556 from the belt 512, while the fine adjustment aligner 550 operates in a manner such that the cylinder 560 may raise or lower the wheel 564 from the belt 512.

The course adjustment aligner 548 has a forward sensor 568 located forwardly of the wheel 556 over the belt 512 and spaced a substantial distance from a plate or edge 570 against which it is desirable to align the sleeve. The course adjustment aligner 548 also has a rear sensor 572 located rearwardly of the wheel 556 and in close proximity to the edge against which the sleeve is to be aligned. As the sleeve passes along the belt 512, both the sensors 568 and 572 are verified by the central processing unit to determine the presence of the sleeve beneath the respective sensors 568 and 572. In the event that the sensor 568 indicates presence of the sleeve, while the sensor 572 indicates that the sleeve is not beneath the sensor 572, the cylinder 552 raises and lowers the wheel 556, and causes pulsating movement of the sleeve toward the edge 570 to the desired aligned position. However, once the sensor 572 indicates presence of the sleeve beneath the sensor 572, the central processing unit causes actuation of the cylinder 552 to lift the wheel 556 and prevents further movement of the sleeve toward the edge 570, since the sleeve is substantially aligned with the edge 570 by the course adjustment aligner 548.

After this operation by the course adjustment aligner 548, the sleeve passes toward the fine adjustment aligner 550 for use in the event that the sleeve moves slightly away from the desired edge 570 for alignment of the sleeve. The fine adjustment aligner 550 has a forward sensor 574 located forwardly of the alignment wheel 564 over the belt 512, and spaced a substantial distance from the edge 570 against which the sleeve is to be aligned. The fine adjustment aligner 550 also has a rear sensor 576 located rearwardly of the wheel 564, and adjacent the edge 570 against which the sleeve is to be aligned. The fine adjustment aligner 550 works in substantially the same manner as the course adjustment aligner 548. In the event that the sensor 574 indicates presence of the sleeve, but the sensor 576 indicates that the sleeve is not beneath the sensor 576, the cylinder 560 causes pulsating movement of the alignment wheel 564 against the sleeve, such that the pulsating wheel 564 causes movement of the sleeve toward the edge 570. However, once the sensor 576 detects presence of the sleeve beneath the sensor 576, the central processing unit causes actuation of the cylinder 560 in order to lift the wheel 564 from the sleeve, and prevent further movement of the sleeve toward the edge 570. In this manner, the fine adjustment aligner 550 causes fine alignment of the sleeve against the edge 570 in preparation for sewing by the sewing machine 64.

The sleeve loader 50 has a pair of elongated blowers 578 and 580, respectively, extending laterally across the rejection assembly 62 and the belt 512, with the blowers 578 and 580 having a plurality of apertures disposed longitudinally along the blowers 578 and 580, and with the blowers 578 and 580 being rotatably mounted on the sleeve loader by a plate 582. The alignment assembly 60 has a sensor 584 disposed adjacent the edge 570 against which the sleeve is aligned, and located forwardly of the blower 580. Once the sensor 584 detects presence of the sleeve beneath the sensor 584, the central processing unit actuates the blowers 578 and 580 after a suitable delay which is programmable by the operator, in order to direct air from the apertures of the blowers 578 and 580 against the sleeve in the event that any folds remain in the sleeve adjacent the opposed edges of the sleeve.

With reference to FIG. 1, the detection assembly 58 has a double ply detector 586 disposed over one side of the belts 528 in order that it is in position to sense the sleeves passing beneath the detector 586, which operates in the same manner whether the sleeve was initially folded or flat. The detector 586 is utilized to detect whether more than one ply of the sleeves are present beneath the detector 586, since it is undesirable to permit more than one ply of the sleeve to pass through the sewing machine 64, which includes the case in which one sleeve may be folded into two plies. The detector 586 which has a high power infrared beam which is directed against the sleeves, whether one or more plies, and the detector 586 senses the thickness of the material without contacting the sleeves, and the resulting signals from the detector 586 to the central processing unit are different whether one or two plies of the sleeves are present beneath the detector 586. Initially, the central processing unit permits the passage of a plurality of sleeves beneath the detector 586, such as three sleeves, having only one ply in order to determine the appropriate values or calibration of the sleeves for setting up subsequent determination of one or two plies of the sleeves by the detector 586. In the later event that there is more than one ply of the sleeves, the detector 586 in conjunction with the central processing unit determines this configuration. As will be further discussed below, the detection assembly 58 also has a reading device 588 which senses weaves (course and smooth) of the sleeves beneath the reading device 588 on the belts 528. The reading device 588 also has a sensor 589 for the sleeves which cooperates with an encoder on the shaft 518. The sensor 589 starts the encoder to count when it detects the leading edge of a sleeve, and stops counting of the encoder when it detects the trailing edge of the sleeve. The central processing unit utilizes the count as determined by the encoder in conjunction with the known speed of the conveyor belts 528 to determine the length of a sleeve, and divide the length of the sleeve by half to determine the half-length of the sleeve. In this manner, it is determined whether the sleeves on the belts 528 are not the correct size, may be folded, or have a double-ply.

Figure 6:
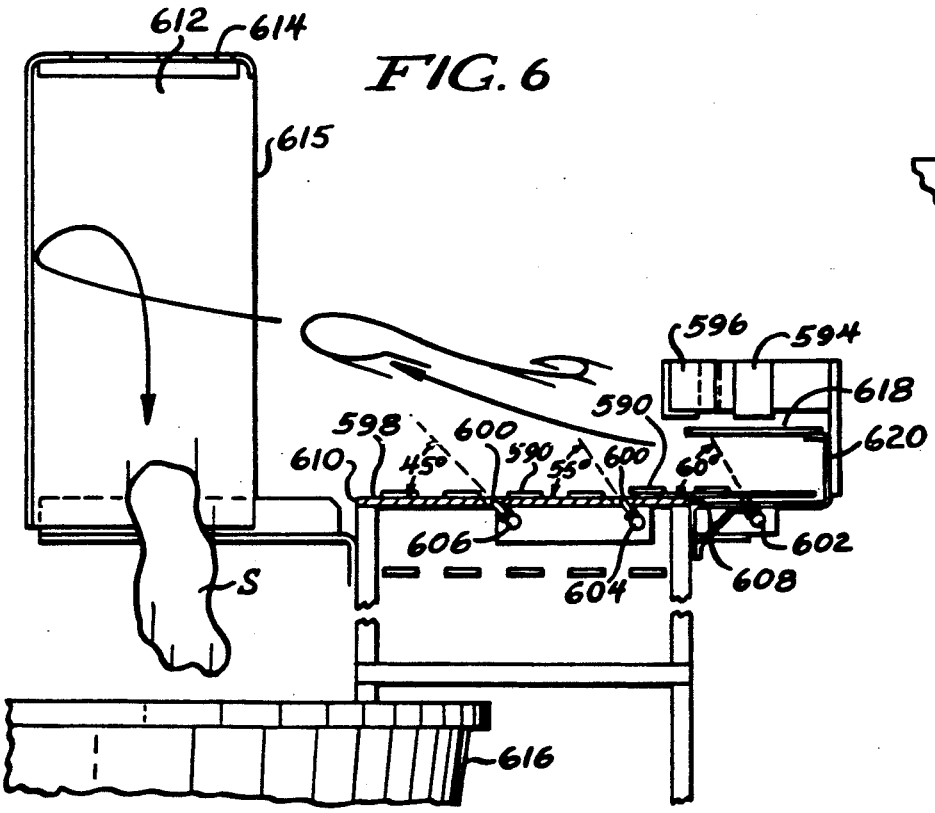
FIG. 6 is a sectional view taken substantially as indicated along the line 6—6 of FIG. 4.

With reference to FIGS. 1, 4, and 6, the rejection assembly 62 has a plurality of endless belts 590 which are driven by rotatable shaft 592. The rejection assembly 62 has a first sensor 594 located forwardly of a second sensor 596, with the sensor 594 being located near to the desired edge of the sleeve after alignment. The sensor 594 is connected to an encoder in order to determine the length of the sleeve as it passes beneath the sensor 594, and whether it may be in a folded configuration, such as an edge folded over part of the sleeve. In addition, the sensors 594 and 596 cooperate in order to determine proper alignment of the sleeves beneath the sensors 594 and 596, i.e. both the sensors 594 and 596 should detect presence of the sleeve beneath the sensors 594 and 596 if the sleeve is properly aligned. The central processing unit then determines whether the sleeve is properly aligned on the rejection assembly 62, whether the sleeve may have a fold, whether the sleeve is not the proper size, or whether more than one ply of the sleeve may be present as determined by the double-ply detector 586, as previously discussed. In the event that the sleeve is in the proper configuration and orientation for sewing, the sleeve is permitted to pass to the sewing machine 64 for sewing a suitable hem in the sleeve. However, in the event that one of these conditions for the sleeve is not satisfied, such as the configuration and orientation, including the case in which more than one ply of the sleeve is present, the sleeve is prevented from passing to the sewing machine 64 in a manner as described below.

The rejection assembly 62 has an upper plate 598 with a plurality of openings 600 located at spaced locations laterally in the plate 598. The rejection assembly 62 has a plurality of blowers 602, 604 and 606 sequentially arranged with associated nozzles directed at lower angles such as 60 degrees, 55 degrees, and 45 degrees relative to the plate 598 in a direction from an inner side 608 toward an outer side 610 of the plate 598. Thus, in the event of an incorrect configuration or orientation of a sleeve on the rejection assembly 62, the blowers 602, 604, and 606 are actuated by the central processing unit in order to blow air at the different angles to cause movement of the sleeve past the outer side 610 of the plate 598 into the cavity 612 of a collector 614 having an opening 615 to receive the rejected sleeves where movement of the sleeve is deflected, and the rejected sleeve drops into a lower receptacle 616 for collection therein. During this time, a horizontal panel 618 which is secured by a plate 620 above the belts 590, assists in maintaining the air beneath the panel 618 in order to facilitate rolling out of the sleeve by the blowers disposed at differing angles towards the collector 614.

Thus, in this matter only sleeves which are in proper configuration or orientation are passed to the sewing machine 64, while sleeves which are not in the correct orientation or configuration are rejected by the rejection assembly 62 and are collected in the receptacle 616 for suitable disposal.

In the case of initially flat sleeves, it is necessary to determine the side of the sleeve which is facing upwardly from the sleeve as it passes to the sewing machine 64, since it is desirable to sew the sleeve with the proper side facing in the correct vertical orientation. With reference to FIG. 1, and FIGS. 39–42, the reading device 588 determines which side of the sleeve is facing upwardly on the belts 528 through use of an infrared sensor which averages over the length of the sleeve for comparing the surface of the sleeve in a reflective manner. The inside of the sleeve has an irregular pattern, while the outside of the sleeve has a line orientated pattern, and in the event that the outside of the sleeve is facing toward the reading device 588 reflection is sent back to the reading device 588 which is determined by the device 588 and is indicated to the central processing unit.

As previously discussed, the sensor 589 is utilized with the encoder on the shaft 518 in order to divide the length of the sleeve in half as determined by the central processing unit. The sleeve then passes toward the control plate 540 for further processing, as will be discussed below. In the event that the reading device 583 determines that the sleeve is in the correct orientation, the central processing unit maintains the plate 540 in an upper position, as best shown in FIG. 41, to permit direct passage of the sleeve from the detection assembly 58 to the alignment assembly 60, as indicated by the arrow A in the drawing, without processing of the sleeve. However, in the event that the reading device 588 determines that the sleeve is not facing in the correct orientation for sewing, the sleeve is inverted in a manner as discussed below.

Figure 39:
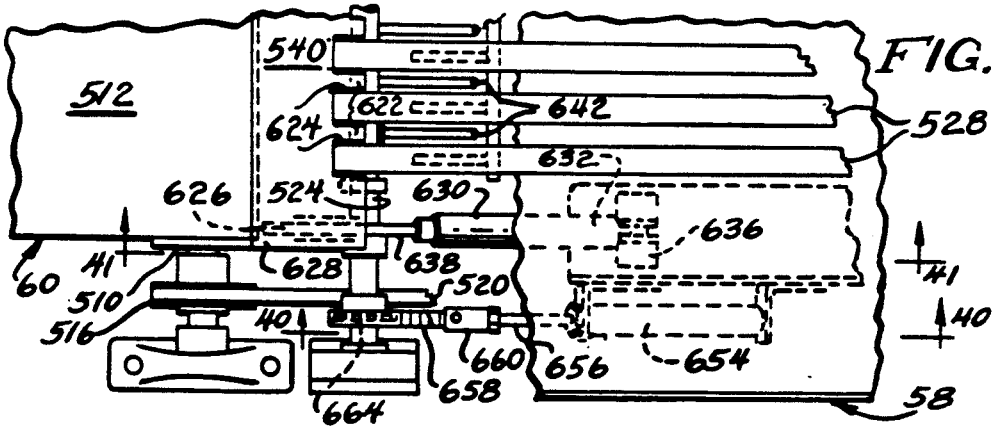
FIG. 39 is a fragmentary top plan view illustrating a bypass plate and flipper blower fingers according to the present invention.
Figure 41:
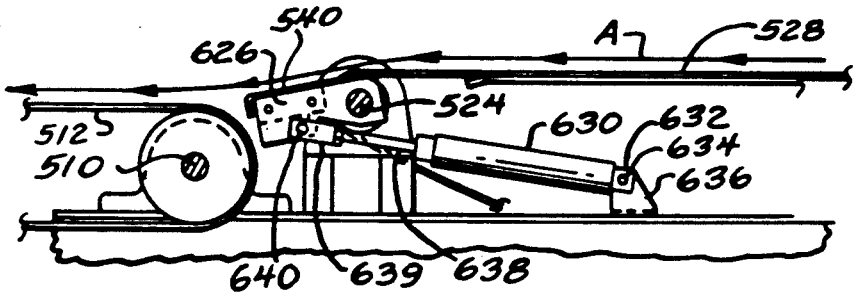
FIG. 41 is a fragmentary elevational view showing the control plate in an upper position taken substantially as indicated along the line 41—41 of FIG. 39.
Figure 42:
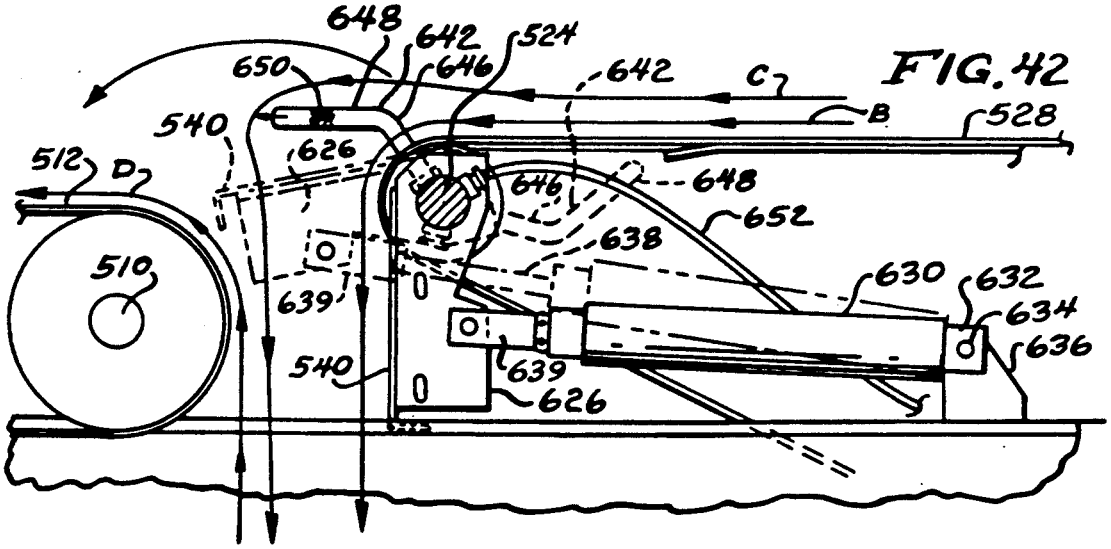
FIG. 42 is a fragmentary elevational view illustrating the control plate in a lower position, and the flipper blower fingers located in outer and retracted positions.
Figure 43:
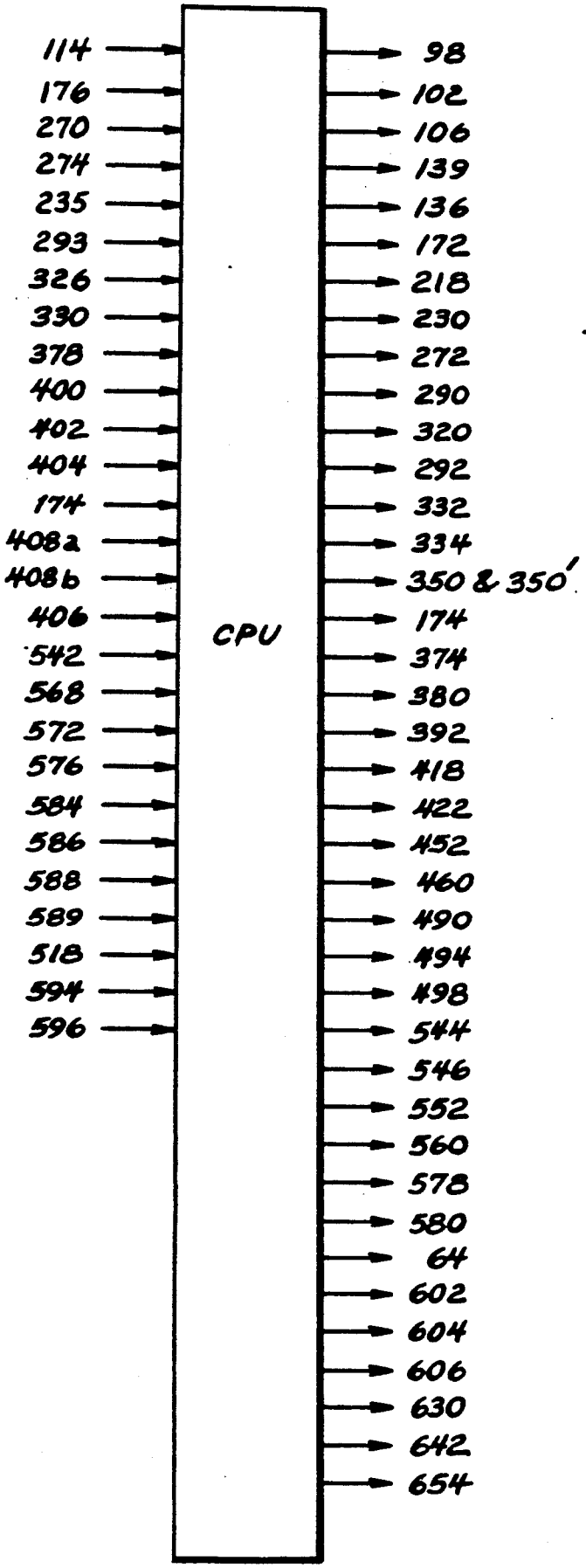
FIG. 43 is a diagrammatic view of a central processing unit for the sleeve loader of the present invention.

The plate 540 has a plurality of inner spaced fingers 622 defining notches 624 to receive the belts 528 passing around the shaft 524. The plate 540 is secured to a depending flange 626 adjacent one end 628 of the plate 540, with the flange 626 being pivotally mounted to the shaft 524. The detection assembly 58 has a cylinder 630 having an inner end 632 pivotally mounted by a pin 634 to a fixed plate 636. The cylinder 630 has an extendable piston 638 having an outer end 639 pivotally mounted by a pin 640 to the flange 626. When the piston 638 of the cylinder 630 is actuated by the central processing unit to extend the piston 638, the plate 540 is located in the upper position, as shown in FIGS. 39 and 41, to permit direct passage of the sleeve over the plate 540 from the detection assembly 58 onto the alignment assembly 60. However, when the reading device 588 determines that the sleeve is not located in the correct orientation, the central processing unit actuates the cylinder 630 in order to retract the piston 638 and draw the plate 540 to a lower vertical position, as shown in solid lines in FIG. 42, with the cylinder 630 pivoting about the pin 634 to a lower position with the piston 638 retracted. Hence, in the event that the sleeve is not orientated in the correct vertical position, the sleeve passes about the ends of the belts 528 around the shaft 524 to a lower vertical position generally aligned with the plate 540, as indicated by the direction of the arrows along the line B, as shown in FIG. 42, such that the opposed ends of the sleeve are located about the belts 528 and extend along the plate 540. When one-half the length of the sleeve has passed about a predetermined position relative to the shaft 524, the detection assembly 58 causes inversion of the sleeve in a manner that will be described below.

Figure 40:
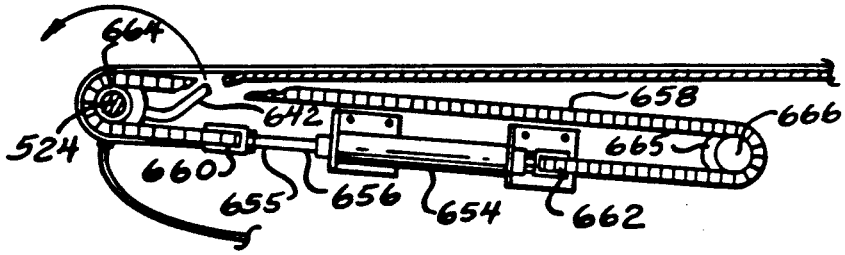
FIG. 40 is a fragmentary elevational view, partly in section, taken substantially as indicated along the line 40—40 of FIG. 39.

With reference to FIGS. 39, 40, and 42, the detection assembly 58 has a plurality of hollow flipper blower fingers 642 secured to the shaft 524. The flipper blower fingers 642 have a first straight inner portion 646 extending from the shaft 524, and an outer inclined portion 648 extending at an angle relative to the inner portion 646. The flipper blower fingers 642 have a passageway 650 extending the length of the flipper blower fingers 642, and communicating through the shaft 524 with an elongated conduit 652 which is connected to a source of air, such that air may be passed through the conduit 652, the shaft 524 and through the flipper blower fingers 642.

The detection assembly 58 has a second cylinder 654 having a movable piston 656 extending through the cylinder 654. An elongated chain 658 has one end 660 connected to an outer end 655 of the piston 656, and a second end 662 is connected to an inner end 657 of the piston 656 which extends through the cylinder 654. The chain 658 passes around a sprocket 664 secured to the shaft 524, and around a sprocket 665 on a shoulder screw 666 between the inner and outer ends 657 and 655 of the piston 656. Thus, the cylinder 654 may be actuated in order to move the piston 656 to an outer position during which the flipper blower fingers 642 are moved to a lower retracted position, as shown in FIG. 40 and in dotted lines in FIG. 42. When the cylinder 654 is actuated to move the piston 656 to an inner position, the chain 658 rotates the sprocket 664 on the shaft 524 in a direction moving the flipper blower fingers 642 between the belts 528 of the detection assembly 58 to a second outer position, with the flipper blower fingers 642 extending generally toward the alignment assembly 60, shown in solid lines in FIG. 42.

Thus, in accordance with the present invention, as the plate 540 is placed in its lower position, and the sleeve passes into the configuration relative to the half-length of the sleeve as determined by the central processing unit, the cylinder 654 is actuated by the central processing unit at a calculated time in order to move the flipper blower fingers 642 from the inner retracted position to the outer position, and the source of air is actuated in order to pass air through the flipper blower fingers 642 onto the sleeve at approximately half the length of the sleeve, thus moving the sleeve from the configuration as indicated by the line B in FIG. 42 toward the line C as shown in FIG. 42, at which time the sleeve is blown toward the alignment assembly 60 in order to invert the configuration of the sleeve from the initial orientation into a turned orientation onto the belt 512 of the alignment assembly 60, as shown by the line D in FIG. 42, with the sleeve being moved by the belt 512 in its inverted configuration along the alignment assembly 60 for subsequent alignment of the sleeve with the sleeve located in the correct inverted orientation for sewing.

In accordance with the present invention, the operator may select through the central processing unit the duration during which the flipper blower fingers 642 remain in the outer extended position, the duration the air passes through the flipper blower fingers 642, the time at which the air turns on relative to the movement of the flipper blower fingers 642 from the inner to outer positions, and which particular flipper blower fingers 640 cause passage of air, such that some of the flipper blower fingers 642 may be inhibited from passage of air. The manner in which these parameters are selected are determined according to the size of the sleeve, the material type, porosity, shape, and weight in order to adjust the parameters to the particular material. After passage of the sleeve onto the belt 512 of the alignment assembly 60, the cylinder 654 is actuated by the central processing unit in order to extend the piston 656 and move the associated chain 658, such that the flipper blower fingers 642 are moved to the inner retracted position, as again shown in dotted lines in FIG. 42. At this time, the flipper blower fingers 642 are retracted to an inoperative position, with the air source removed from the flipper blower fingers 642 and the sleeve passes along the belt 512 for processing by the alignment assembly 60 in a manner as previously described.

The foregoing detailed description is given for clearness of understanding only, and no unnecessary limitations should be understood therefrom, as modifications will be obvious to those skilled in the art.

What is claimed is:

1. An apparatus for processing a stack of garments for sewing, comprising:

means for retaining the stack of garments;

means for picking up at least one garment from atop the stack, the pick up means having at least two spaced generally aligned pick up fingers for grasping;

means for moving the picking up means towards the retaining means;

means for sensing an edge of the garment stack;

means responsive to the sensing means for stopping the picking up means adjacent an edge of the garment stack to permit operation of the picking up means; and means for maneuvering the removed garment from a first operative position above the retaining means, toward a second service position spaced from the retaining means while aligning the garment in a desired configuration.

2. The apparatus of claim 1 wherein the retaining means comprises:

a tray having reflective means extending from the stack to an edge of the tray, and means for sensing carried by the moving means, such that the sensing means senses the presence of the reflective means.

3. The apparatus of claim 1 wherein the pick up assembly comprises a gripper finger carriage, gripper fingers, means for moving the gripper fingers together and means for moving the gripper finger to a position where it can engage a garment from the top of the garment stack.

4. The apparatus of claim 1, wherein the pick up fingers may be rotated about a pivot point on a side of the pick up fingers to an angle such that the pick up fingers are disposed at a predetermined angle relative to the stack of garments.

5. The apparatus of claim 4, including means for generating a signal representing the angular position of the pick up assembly.

6. An apparatus for process a stack of garments for sewing, comprising:

means for retaining the stack of garments;

a pick up assembly having a plurality of spaced generally aligned pick up fingers, the pick up fingers having a pair of opposed fingers;

means for positioning the pick up assembly and the retaining means in a position with an outer end of the pick up fingers located adjacent an upper ply of the garment;

means for moving the fingers between a first open position and a second closed position to grasp the upper ply of the garment stack;

means for selectively inhibiting the moving means of at least one pick up finger; and means for maneuvering the garment from a first operative position above the retaining means toward a second service position spaced from the retaining means, while aligning the garment in a desired configuration.

7. The apparatus of claim 6 including means for rotating the pick up assembly about a pivot point on a side of the pick up fingers to an angle such that the pick up fingers are disposed at a predetermined angle relative to the garments.

8. The apparatus of claim 7 wherein the rotating means rotates the pick up assembly between predetermined angles of the pick up fingers on opposed sides of a central position.

9. The apparatus of claim 8 including means for adjustably stopping the pick up assembly placed at spaced locations to define the predetermined angles.

10. The apparatus of claim 7 including means for generating a signal representing the angular position of the pick up assembly.

11. The apparatus of claim 7 including a plate for supporting the pick up fingers, a shaft, and means for pivotally connecting the plate to the shaft to define the pivot point.

12. The apparatus of claim 7 including adjustable stop means for the pick up assembly to define the predetermined angle.

13. The apparatus of claim 7, including a means for generating a signal representing the angular position of the pick up assembly.

14. An apparatus for processing a stack of garments for sewing, comprising:

means for retaining the stack of garments;

a support plate having an arcuate outer edge;

a pick up assembly having a plurality of pick up fingers, means for supporting the pick up fingers in a generally aligned configuration, and a pair of generally aligned rotatable rollers pivotally connected to the supporting means to receive an edge of the support plate adjacent the edge;

means for rotatably supporting the pick up assembly on the support plate;

means for rotating the pick up assembly about the pick up assembly supporting means between predetermined spaced angles of the pick up fingers;

means for selectively moving at least one of the support plate and retaining means between a first position with the pick up fingers spaced from the stack of garments, and a second position with the pick up fingers located adjacent the stack of garments;

means for selectively opening and closing the pick up fingers to grasp an upper ply of the stack; and means for maneuvering the removed garment from a first operative position above the retaining means toward a second service position spaced from the retaining means, while aligning the garment in a desired configuration.

15. The apparatus of claim 14 including a separate pick up finger, means for securing the separate pick up finger to the support plate adjacent the pick up assembly, and means for selectively opening and closing the separate pick up finger to grasp the upper ply of the stack.

16. An apparatus for processing a stack of garments for sewing, comprising:

means for retaining the stack of garments adapted to hold at least one stack of garments and which can be maneuvered to position the stack to a desired location;

means for successively removing a garment from the top of the stack when the stack is in the desired location while maintaining the remainder of the stack in its existing configuration;

means for maneuvering the removed garment from a first operative position above the retaining means toward a second service position spaced from the retaining means, while aligning the garment in a desired configuration;

a plurality of flutter fingers having a hollow tubular section connected to a plate, the tubular section having an orifice directed towards a lower surface of the plate;

means for passing a gas through the flutter fingers;

means for supporting the flutter fingers in a generally aligned and spaced configuration; and means for moving the supporting means and the retaining means relative to each other between a first position with the flutter fingers spaced from the stack of garments, and a second position with the flutter fingers located adjacent the stack of garments.

17. The apparatus of claim 16 including means for pivotally mounting the supporting means to rotate the flutter fingers to a predetermined angular position.

18. The apparatus of claim 17 including means for determining the predetermined angle.

19. The apparatus of claim 17 including a separate flutter finger having a tubular section connected to a plate, the tubular section having an orifice directed towards a lower surface of the plate, means for mounting the separate flutter plate at a fixed position on a side of the supporting means for movement between a first position spaced from the stack of garments and a second position adjacent the stack of garments, and means for passing gas through the separate flutter finger.

20. The apparatus of claim 19 wherein the mounting means comprises, an arm connected to the tubular section, means for pivotally supporting the arm, and means for rotating the arm about the pivotally supporting means.

21. The apparatus of claim 20 including a separate hold down finger located at a fixed position adjacent the separate flutter finger, and means for moving the separate hold down finger between a first position spaced from the stack of garments, and a second position engaged against the stack of garments.

22. The apparatus of claim 21 including a plurality of hold down fingers located intermediate at least some of the rotatable flutter fingers, means for moving the hold down fingers between a first position spaced from the stack of garments, and a second position against the stack of garments, and means for pivotally mounting the hold down fingers to permit rotation to the predetermined angle with the flutter fingers.

23. The apparatus of claim 16 including means for moving the supporting means between a first inner position and a second outer position.

24. The apparatus of claim 16 including a plurality of generally aligned hold down fingers located intermediate at least some of the flutter fingers and being generally directed toward the retaining means, and means for moving the hold down fingers between a first position spaced from the stack of garments, and a second position engaged against the stack of garments.

25. The apparatus of claim 24 including means for rotating the hold down fingers to a predetermined angle.

26. The apparatus of claim 16 including means for selectively inhibiting at least one of the flutter fingers.

27. The apparatus of claim 16, wherein the gas passing means is a blower conduit connecting a blower and a diverter valve which controls the passage of air from the blower.

28. The apparatus of claim 16, wherein the gas passing means is a blower conduit connecting a blower and a diverter valve, the diverter valve controlling the passage of air from the blower.

29. An apparatus for processing a stack of garments for sewing, comprising:

means for retaining the stack of garments;

a pick up assembly having a plurality of spaced generally aligned pick up fingers having means for selectively opening and closing the pick up fingers for grasping a garment from atop of the stack;

means for pivotally mounting the pick up assembly;

means for rotating the pick up assembly to a preselected angular position of the pick up fingers with the pick up fingers disposed over the stack of garments;

a plurality of flutter fingers having a plate, and means for passing gas along a lower surface of the plate;

means for supporting the flutter fingers in a generally aligned and spaced configuration;

means for pivotally mounting the supporting means to rotate the supporting means to the preselected angle;

means for positioning the flutter fingers intermediate the pick up fingers; and means for maneuvering the garment from a first operative position above the retaining means toward a second service position spaced from the retaining means, while aligning the garment in a desired configuration.

30. The apparatus of claim 29 including means for determining the angular position of the rotated pick up assembly, and means responsive to the determining means for indicating when the supporting means is rotated to the predetermined angle.

31. The apparatus of claim 29 wherein the positioning means includes means for moving the flutter fingers between a first position spaced from the pick up fingers, and a second position located intermediate the pick up fingers.

32. The apparatus of claim 29 including a plurality of hold down fingers positioned intermediate at least some of the flutter fingers, means for moving the hold down fingers between a first position spaced from the stack of garments, and a second position extending towards the stack of garments, and means for pivotally mounting the hold down fingers to permit rotation with the flutter fingers.

33. The apparatus of claim 32 including a separate flutter finger having a plate, means for passing gas along a lower surface of the plate, and means for supporting the separate flutter finger at a fixed position adjacent an end of the supporting means.

34. The apparatus of claim 33 including a separate hold down finger located at a fixed position adjacent the separate flutter finger, and means for moving the separate flutter finger between a first position spaced from the stack of garments, and a second position extended towards the stack of garments.

35. The apparatus of claim 25 including a separate pick up finger disposed at a fixed position adjacent an end of the pick up assembly, a separate flutter finger having a plate, means for passing gas along a lower surface of the plate, means for supporting the separate flutter finger adjacent an end of the supporting means, and means for moving the flutter fingers between a first position with the plural flutter finger spaced from the plural pick up finger and the separate flutter finger spaced from the separate pick up finger, and a second position with the plural flutter fingers located intermediate the plural pick up fingers, and the separate flutter finger located intermediate the pick up assembly and the separate pick up finger.

36. The apparatus of claim 29, including a linear scale.

37. An apparatus for processing a stack of garments for sewing, comprising:

means for retaining the stack of garments;

a gripper finger carriage having means for picking up an upper garment;

a flutter finger carriage having means for lifting the upper garment to facilitate pick up by the picking up means;

means for moving the gripper finger carriage to a pick up position over the garment stack;

means for determining the pick up position of the gripper finger carriage;

means for moving the flutter finger carriage towards the gripper finger carriage;

means responsive to the determining means for stopping the flutter finger carriage adjacent the gripper finger carriage in position for lifting and picking up a garment; and means for maneuvering the garment from a first operative position above the retaining means toward a second service position spaced from the retaining means, while aligning the garment in a desired configuration.

* * * * *